US008355660B2

(12) United States Patent
Nanjo

(10) Patent No.: US 8,355,660 B2
(45) Date of Patent: Jan. 15, 2013

(54) FIXING DEVICE WITH A SHIELDING MEMBER HAVING AN INSULATED CIRCUMFERENTIAL PART AND IMAGE FORMING APPARATUS INCLUDING SAME

(75) Inventor: Yuzuru Nanjo, Osaka (JP)

(73) Assignee: Kyocera Mita Corporation (JP)

( * ) Notice: Subject to any disclaimer, the term of this patent is extended or adjusted under 35 U.S.C. 154(b) by 367 days.

(21) Appl. No.: 12/763,251

(22) Filed: Apr. 20, 2010

(65) Prior Publication Data

US 2010/0272483 A1 Oct. 28, 2010

(30) Foreign Application Priority Data

Apr. 24, 2009 (JP) ..... 2009-106717

(51) Int. Cl.
*G03G 15/20* (2006.01)

(52) U.S. Cl. ..... 399/329; 219/216; 219/619; 399/330

(58) Field of Classification Search ..... 399/328, 399/329, 330, 331, 334; 219/216, 619, 643
See application file for complete search history.

(56) References Cited

U.S. PATENT DOCUMENTS

| | | | | |
|---|---|---|---|---|
| RE36,962 | E | 11/2000 | Higashi et al. | |
| 6,849,838 | B2 * | 2/2005 | Shimizu et al. | 219/635 |
| 7,369,804 | B2 * | 5/2008 | Yasuda et al. | 399/330 |
| 7,433,639 | B2 * | 10/2008 | Yasuda et al. | 399/329 |
| 7,835,680 | B2 * | 11/2010 | Nanjo et al. | 399/329 |
| 7,890,042 | B2 * | 2/2011 | Ishida et al. | 399/329 |
| 7,995,958 | B2 * | 8/2011 | Gon et al. | 399/332 |
| 8,078,072 | B2 * | 12/2011 | Nanjo et al. | 399/67 |
| 8,175,509 | B2 * | 5/2012 | Gon | 399/330 |
| 2009/0175644 | A1 * | 7/2009 | Nanjo et al. | 399/69 |
| 2009/0214243 | A1 * | 8/2009 | Yoda et al. | 399/69 |
| 2010/0028061 | A1 * | 2/2010 | Nanjo et al. | 399/328 |
| 2010/0046996 | A1 * | 2/2010 | Nanjo et al. | 399/330 |
| 2010/0272482 | A1 * | 10/2010 | Nanjo | 399/328 |
| 2011/0052281 | A1 * | 3/2011 | Gon | 399/329 |
| 2011/0318076 | A1 * | 12/2011 | Tanda | 399/329 |
| 2012/0099909 | A1 * | 4/2012 | Nanjo | 399/329 |

FOREIGN PATENT DOCUMENTS

| | | |
|---|---|---|
| JP | 6-318001 | 11/1994 |
| JP | 2003-107941 | 4/2003 |
| JP | 3527442 | 2/2004 |
| JP | 2008065189 A * | 3/2008 |

* cited by examiner

*Primary Examiner* — Robert Beatty
(74) *Attorney, Agent, or Firm* — Gerald E. Hespos; Michael J. Porco

(57) ABSTRACT

A fixing device is provided with a heating member, a pressing member, a coil, a fixed core, a movable core and a shielding member provided on the movable core and a position switching unit moving the shielding member between a shielding position where a ring part shields magnetism and a retracted position where the ring part does not shield magnetism. A first area requiring magnetic shielding and a second area not requiring magnetic shielding are selectively set in the heating member. The shielding member includes a first annular portion provided at a position corresponding to a boundary part between the first and second areas, and the first annular portion has a shape closed in a circumferential direction and is electrically insulated at a circumferential part when viewed in an axial direction of the movable core.

20 Claims, 19 Drawing Sheets

FIG.10A
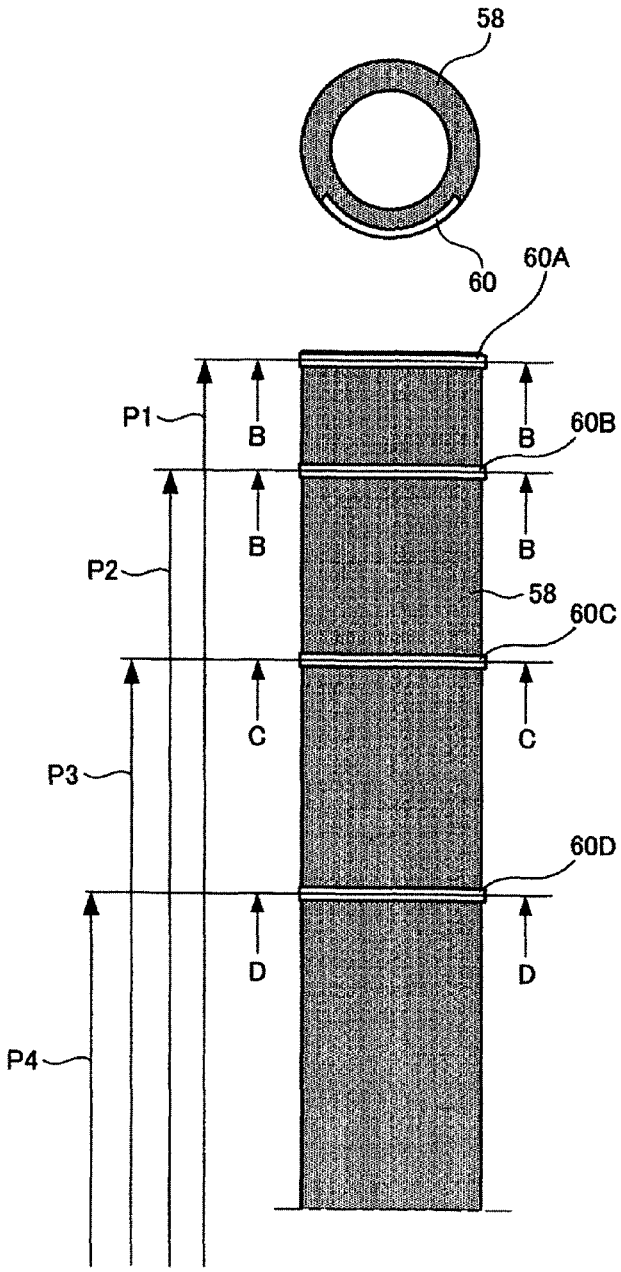
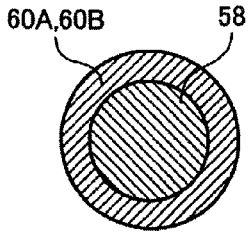
FIG.10B
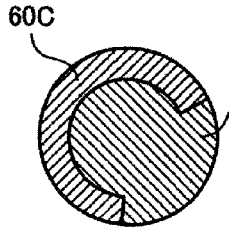
FIG.10C
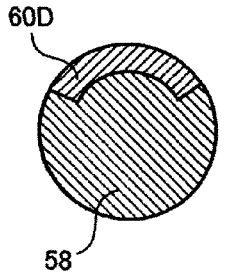
FIG.10D

COMPLETE SHIELDING(0°)

MIDDLE/SMALL SIZE SHIELDING (120°)

NO SHIELDING (180°)

MIDDLE SIZE SHIELDING (240°)

FIXING DEVICE WITH A SHIELDING MEMBER HAVING AN INSULATED CIRCUMFERENTIAL PART AND IMAGE FORMING APPARATUS INCLUDING SAME

BACKGROUND OF THE INVENTION

1. Field of the Invention

The present invention relates to a fixing device for heating and melting unfixed toner and fixing it to a sheet bearing a toner image while permitting the sheet to pass a nip between a pair of rollers or between a heating belt and a roller and an image forming apparatus including the fixing device.

2. Description of the Related Art

In recent years, attention has been focused on belt-type image forming apparatuses, in which a smaller heat capacity can be set, due to demands of shortening a warm-up time and saving energy in a fixing device. Attention has been also focused on an electromagnetic induction heating method (IH) with a possibility of quick heating and high efficiency heating in recent years, and many products as a combination of electromagnetic induction heating and the employment of a belt have been commercialized in light of saving energy upon fixing a color image. In the case of combining the employment of a belt and electromagnetic induction heating, an electromagnetic induction device is often arranged outside the belt due to merits that a coil can be easily laid out and cooled and further the belt can be directly heated (so-called external IH).

In the above electromagnetic induction heating method, various technologies have been developed to prevent an excessive temperature increase in a sheet non-passage area in consideration of a sheet width (paper width) passed through the fixing unit. Particularly, the following first and second prior arts are known as size switching means in the external IH.

The first prior art is such that a magnetic member is divided into a plurality of pieces, which are arranged in a sheet width direction, and some of the magnetic member pieces are moved toward or away from an exciting coil in accordance with the size of a sheet to be passed (paper width). In this case, heating efficiency decreases by moving the magnetic member pieces away from the exciting coil in sheet non-passage areas, and the amount of heat generation is thought to be less than in an area corresponding to a sheet with a minimum paper width.

The second prior art is such that that other conductive members are arranged outside a minimum paper width in a heating roller and the positions thereof are switched between those inside and outside the extent of a magnetic field. According to this prior art, the conductive members are first located outside the extent of the magnetic field to heat the heating roller by electromagnetic induction. If the temperature of the heating roller rises to the vicinity of a Curie temperature, the conductive members are moved to the extent of the magnetic field, thereby causing magnetic fluxes to leak from the heating roller outside the minimum paper width for the prevention of excessive temperature increases.

However, in the first prior art, since the movable ranges of the magnetic members are large and an extra space is necessary by that much, there is a problem of inadvertently enlarging the entire device. On the other hand, in the second prior art, space saving is possible since the size switching means are arranged in the heating roller. However, the interior of the heating roller is a high temperature environment, it is necessary to set a high Curie temperature in the case of arranging some members in the interior of the heating roller and, in addition, members with a large heat capacity have a problem of extending a warm-up time.

Here, in order to realize a reduction in the warm-up time and space saving, it is thought to suppress induction heating in the sheet non-passage areas (areas where magnetic shielding is necessary) and use magnetic shielding members capable of induction heating in a sheet passage area (area where magnetic shielding is not necessary). However, it must be also kept in mind that magnetic fields shielded in the sheet non-passage areas need to be allowed to escape to the sheet passage area. If these magnetic fields remain in the sheet non-passage areas, magnetic shielding effects in the sheet non-passage areas weaken, which might hinder the prevention of excessive temperature increases.

SUMMARY OF THE INVENTION

An object of the present invention is to provide a fixing device capable of complete magnetic shielding in sheet non-passage areas by solving the above problems and an image forming apparatus including this fixing device.

In order to accomplish this object, a fixing unit according to one aspect of the present invention includes a heating member; a pressing member, the heating member and the pressing member fixing a toner image to a sheet by heat from the heating member while conveying the sheet having the toner image transferred thereto in a sandwiched state; a coil generating a magnetic field to induction heat the heating member; a fixed core made of a magnetic material and arranged around the coil to form a magnetic path between the fixed core and the heating member; a movable core made of a magnetic material and provided between the fixed core and the heating member with respect to a direction in which the coil generates the magnetic field so as to form the magnetic path together with the fixed core, the movable core having an axis intersecting with the generation direction of the magnetic field and being rotatable about the axis; a shielding member made of a non-magnetic metal, provided on the movable core, and having a ring part capable of shielding magnetism in the magnetic field; a position switching unit rotating the movable core about the axis to move the shielding member between a shielding position where the ring part shields magnetism and a retracted position where the ring part does not shield magnetism, the shielding position being a position where the magnetic field penetrates the ring part in one direction and the retracted position being a position where the magnetic field penetrates the ring part in two directions. A first area requiring magnetic shielding and a second area not requiring magnetic shielding are selectively set in the heating member. The shielding member includes a first annular portion provided at a position corresponding to a boundary part between the first and second areas. The first annular portion has a shape closed in a circumferential direction and is electrically insulated at a circumferential part when viewed in an axial direction of the movable core.

BRIEF DESCRIPTION OF THE DRAWINGS

FIG. 10A is a diagram showing a state where the shielding member is mounted on a center core.

FIG. 10B is a section along B-B of FIG. 10A.

FIG. 10C is a section along C-C of FIG. 10A.

FIG. 10D is a section along D-D of FIG. 10A.

DETAILED DESCRIPTION OF THE PREFERRED EMBODIMENTS

Figure 1:
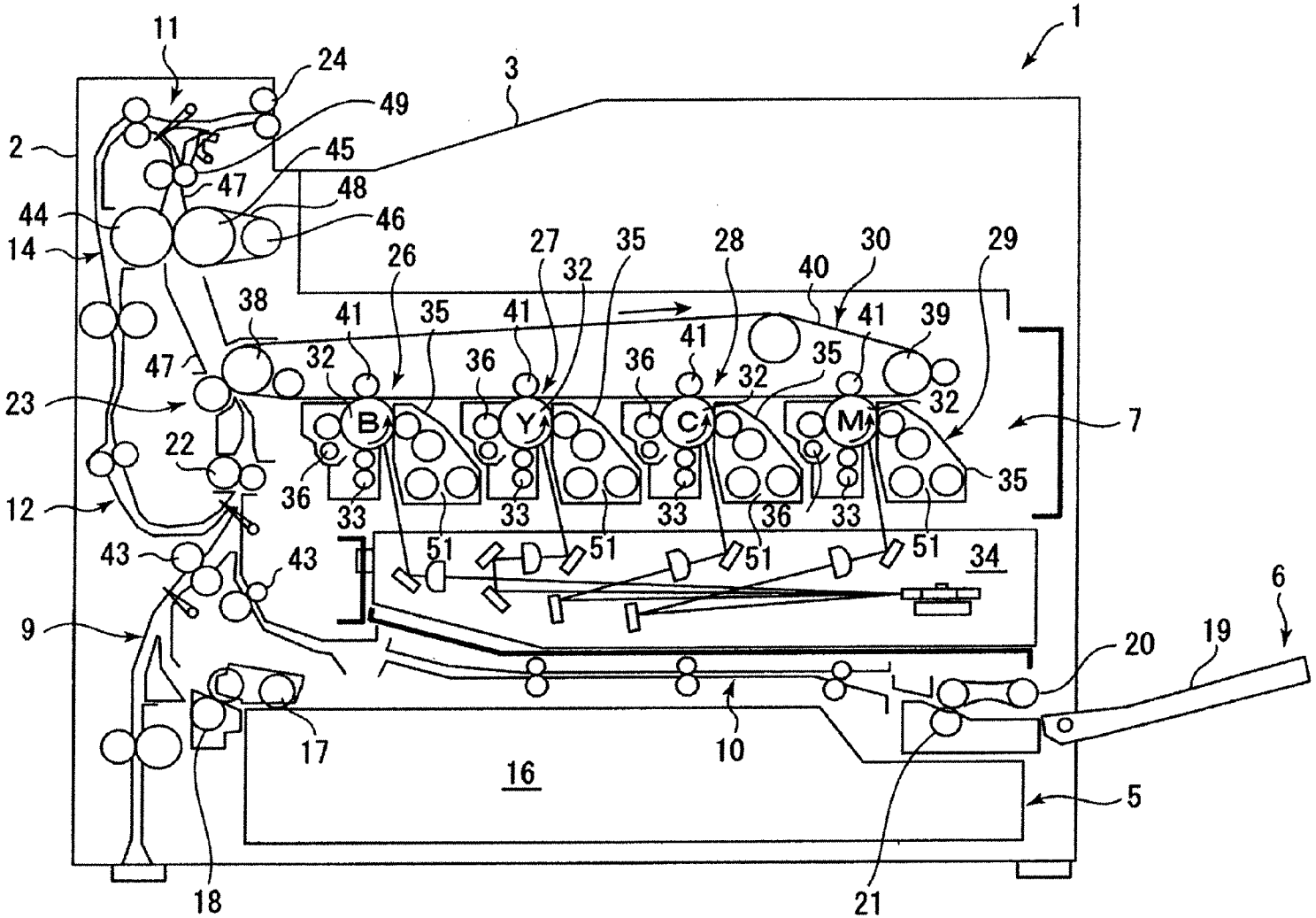
FIG. 1 is a schematic diagram showing the construction of an image forming apparatus according to one embodiment.

Hereinafter, one embodiment of the present invention is described in detail with reference to the accompanying drawings. FIG. 1 is a schematic diagram showing the construction of an image forming apparatus 1 according to one embodiment. The image forming apparatus 1 can be a printer, a copier, a facsimile machine, a complex machine provided with these functions or the like for printing by transferring a toner image to the surface of a print medium such as a print sheet, for example, in accordance with externally inputted image information.

The image forming apparatus 1 shown in FIG. 1 is, for example, a tandem color printer. This image forming apparatus 1 is provided with an apparatus main body 2 in the form of a rectangular box for forming (printing) a color image on a sheet inside. A discharge tray 3, to which a sheet having a color image printed thereon is to be discharged, is provided in a top part of the apparatus main body 2. A sheet cassette 5 for storing sheets is arranged at the bottom in the interior of the apparatus main body 2. A stack tray 6 for manually feeding a sheet is arranged in an intermediate part of the apparatus main body 2. An image forming section 7 is arranged in an upper part of the apparatus main body 2. The image forming section 7 forms an image on a sheet based on an image data such as characters and pictures transmitted from the outside of the apparatus.

A first conveyance path 9 for conveying a sheet dispensed from the sheet cassette 5 to the image forming section 7 is arranged in a left part of the apparatus main body 2 in FIG. 1, and a second conveyance path 10 for conveying a sheet dispensed from the stack tray 6 to the image forming section 7 is arranged from right side to left side. Further, a fixing unit (fixing device) 14 for performing a fixing process to a sheet having an image formed thereon in the image forming section 7 and a third conveyance path 11 for conveying the sheet finished with the fixing process to the discharge tray 3 are arranged in a left upper part in the apparatus main body 2.

The sheet cassette 5 enables the replenishment of sheets by being withdrawn toward the outside (e.g. toward front side in FIG. 1) of the apparatus main body 2. This sheet cassette 5 includes a storing portion 16, which can selectively store at least two types of sheets having different sizes in a feeding direction. Sheets stored in the storing portion 16 are dispensed one by one toward the first conveyance path 9 by feed rollers 17 and a separation roller 18.

The stack tray 6 can be opened and closed relative to an outer surface of the apparatus main body 2, and sheets to be manually fed are placed one by one or a plurality of sheets are placed on a manual feeding portion 19. Sheets placed on the manual feeding portion 19 are dispensed one by one toward the second conveyance path 10 by a pickup roller 20 and a separation roller 21. The first conveyance path 9 and the second conveyance path 10 join before registration rollers 22. A sheet fed to the registration rollers 22 temporarily waits on standby here and is conveyed toward a secondary transfer section 23 after a skew adjustment and a timing adjustment. A full color toner image on an intermediate transfer belt 40 is secondarily transferred to the conveyed sheet in the secondary transfer section 23. Thereafter, the sheet having the toner image fixed in the fixing unit 14 is reversed in a fourth conveyance path 12 if necessary, so that a full color toner image is secondarily transferred also to the opposite side of the sheet in the secondary transfer section 23. After the toner image on the opposite side is fixed in the fixing unit 14, the sheet is discharged to the discharge tray 3 by discharge rollers 24 through the third conveyance path 11.

The image forming section 7 includes four image forming units 26, 27, 28 and 29 for forming toner images of black (B), yellow (Y), cyan (C) and magenta (M) and an intermediate transfer unit 30 for bearing the toner images of the respective colors formed in the image forming units 26 to 29 in a superimposition manner. Each of the image forming units 26 to 29 includes a photosensitive drum 32, a charger 33 arranged to face the circumferential surface of the photosensitive drum 32, a laser scanning unit 34 arranged downstream of the charger 33 with respect to the rotation direction of the photosensitive drum 32 and emitting a laser beam to a specific position on the circumferential surface of the photosensitive drum 32, a developing unit 35 arranged to face the circumferential surface of the photosensitive drum 32 downstream of a laser beam emission position from the laser scanning unit 34 and a cleaning device 36 arranged downstream of the developing unit 35 to face the circumferential surface of the photosensitive drum 32.

The photosensitive drum 32 of each of the image forming units 26 to 29 is rotated in a counterclockwise direction of FIG. 1 by an unillustrated drive motor. Black toner, yellow toner, cyan toner and magenta toner are respectively contained in toner boxes 51 of the developing units 35 of the respective image forming units 26 to 29. The intermediate transfer unit 30 includes a rear roller 38 arranged at a position near the image forming unit 26, a front roller 39 arranged at a position near the image forming unit 29, the intermediate transfer belt 40 mounted on the rear roller 38 and the front roller 39, and four transfer rollers 41 arranged at positions downstream of the developing units 35 in the corresponding image forming units 26 to 29 such that they can be pressed into contact with the photosensitive drums 32 via the intermediate transfer belt 40.

In this intermediate transfer unit 30, the toner images of the respective colors are transferred in a superimposition manner on the intermediate transfer belt 40 at the positions of the transfer rollers 41 in the respective image forming units 26 to 29 and a full color toner image is finally formed on the intermediate transfer belt 40. The first and second conveyance paths 9, 10 are for conveying sheets dispensed from the sheet cassette 5 and the stack tray 6 toward the intermediate transfer unit 30 and include a plurality of conveyor rollers 43 arranged at specified positions in the apparatus main body 2 and the registration rollers 22 arranged before the intermediate transfer unit 30 for timing an image forming operation and a sheet feeding operation in the image forming section 7.

The fixing unit 14 fixes an unfixed toner image to a sheet by heating and pressing the sheet having the toner image transferred thereto in the image forming section 7. The fixing unit 14 includes a pair of rollers, for example, comprised of a heating-type pressing roller (pressing member) 44 and a fixing roller 45. The pressing roller 44 is, for example, a metallic roller, and the fixing roller 45 is comprised of a metallic core material, an outer layer (e.g. silicon sponge) made of elastic material and a mold releasing layer (e.g. PFA). The fixing unit 14 further includes a heat roller 46 disposed adjacent to the fixing roller 45 and a heating belt (heating member) 48 mounted on this heat roller 46 and the fixing roller 45. The heating belt 48 and the pressing roller 44 fix the toner image to the sheet having the toner image transferred thereto by heat from the heating belt 48 while conveying the sheet sandwiched therebetween. The detailed construction of the fixing unit 14 is further described later.

Conveyance paths 47 are arranged upstream and downstream of the fixing unit 14 in a sheet conveying direction. A sheet conveyed through the intermediate transfer unit 30 is introduced to a nip between the pressing roller 44 and the fixing roller 45 via the upstream conveyance path 47. The sheet having passed between the pressing roller 44 and the fixing roller 45 is guided to the third conveyance path 11 via the downstream conveyance path 47.

The third conveyance path 11 conveys the sheet finished with the fixing process in the fixing unit 14 to the discharge tray 3. Thus, conveyer rollers 49 are arranged at a suitable position in the third conveyance path 11 and the above discharge rollers 24 are arranged at the exit of the third conveyance path 11.

[Details of the Fixing Unit]

Next, the details of the fixing unit 14 applied to the image forming apparatus 1 are described.

Figure 2:
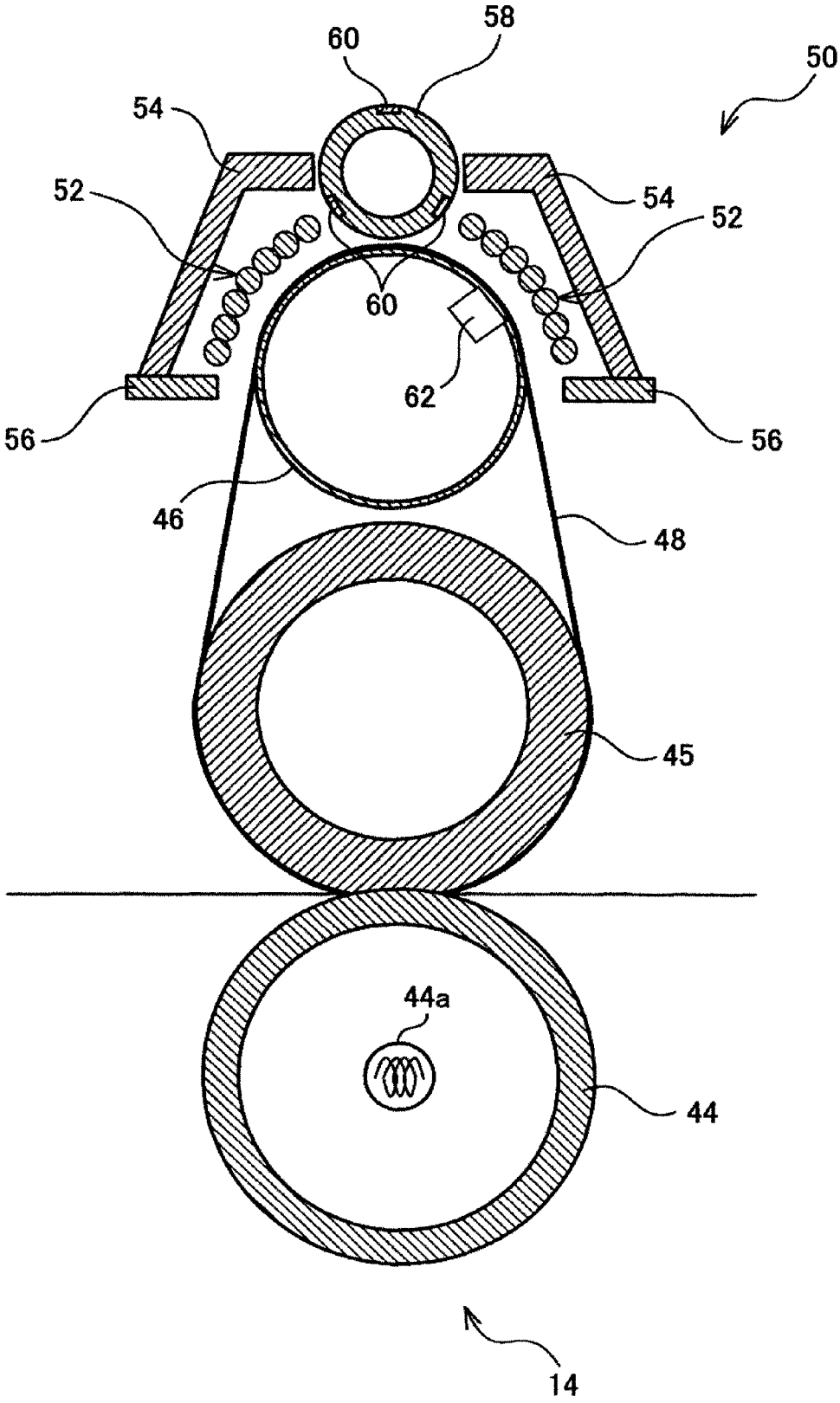
FIG. 2 is a vertical section showing a constructional example of a fixing unit.

FIG. 2 is a vertical section showing a constructional example of the fixing unit 14. In FIG. 2, the orientation of the fixing unit 14 is rotated counterclockwise by about 90° from an actually mounted state in the image forming apparatus 1. Accordingly, the sheet conveying direction from lower side to upper side in FIG. 1 is from right side to left side in FIG. 2. If the apparatus main body 2 has a larger size (complex machine or the like), the fixing unit 14 may be actually mounted in the orientation shown in FIG. 2.

The fixing unit 14 of this embodiment includes the pressing roller 44 having a diameter of e.g. 50 mm, the fixing roller 45 having a diameter of e.g. 45 mm, the heat roller 46 having a diameter of e.g. 30 mm and the heating belt 48 having a thickness of e.g. 35 μm (1 μm=$1\times10^{-6}$ m). The heating belt 48 is adjusted, for example, in a range of 150 to 200° C. As described above, the pressing roller 44 is made of a metal, whereas the fixing roller 45 includes the elastic layer of silicon sponge on the outer layer. Thus, a flat nip is formed between the heating belt 48 and the pressing roller 44. It should be noted that a halogen heater 44*a* is disposed in the pressing roller 44. A base member of the heating belt 48 is made of a ferromagnetic material (e.g. Ni), a thin elastic layer (e.g. silicon rubber) is formed on the outer surface of the base member, and the mold releasing layer (e.g. PFA) is formed on the outer surface of the elastic layer. A core of the heat roller 46 is made of a magnetic metal (e.g. Fe) and a mold releasing layer (e.g. PFA) is formed on the outer surface of the core.

The fixing unit 14 further includes an IH coil unit 50 at an outer side of the heat roller 46 and the heating belt 48. The IH coil unit 50 includes an induction heating coil 52, a pair of arch cores (fixed core) 54, a pair of side cores (fixed core) 56 and a center core (movable core) 58.

[Coil]

In the example of FIG. 2, the induction heating coil 52 is arranged on a virtual arcuate surface extending along an arcuate outer surface for induction heating in arcuate parts of the heat roller 46 and the heating belt 48. Actually, a bobbin (not shown) made of a heat resistant resin such as PPS, PET or LCP is arranged at the outer side of the heat roller 46 and the heating belt 48, and the induction heating coil 52 is wound around this bobbin. The coil 52 is fixed to this bobbin using, for example, a silicon adhesive.

[Fixed Core]

The center core 58 is located in the center in FIG. 2, and the arch cores 54 and the side cores 56 are arranged in pairs at the opposite sides of the center core 58. The arch cores 54 at the opposite sides are cores made of ferrite and formed to have arched cross sections symmetrical with each other, and the entire lengths thereof are longer than a winding area of the induction heating coil 52. The side cores 56 at the opposite sides are cores made of ferrite and having a block shape. The side cores 56 at the opposite sides are connected with one ends (bottom ends in FIG. 2) of the corresponding arch cores 54 and cover the outer side of the winding area of the induction heating coil 52. The arch cores 54 and the side cores 56 are, for example, arranged at a plurality of positions spaced apart in a longitudinal direction of the heat roller 46. The arrangement of the cores 54, 56 are determined, for example, in accordance with a magnetic flux density (magnetic field intensity) of the induction heating coil 52.

Figure 5:
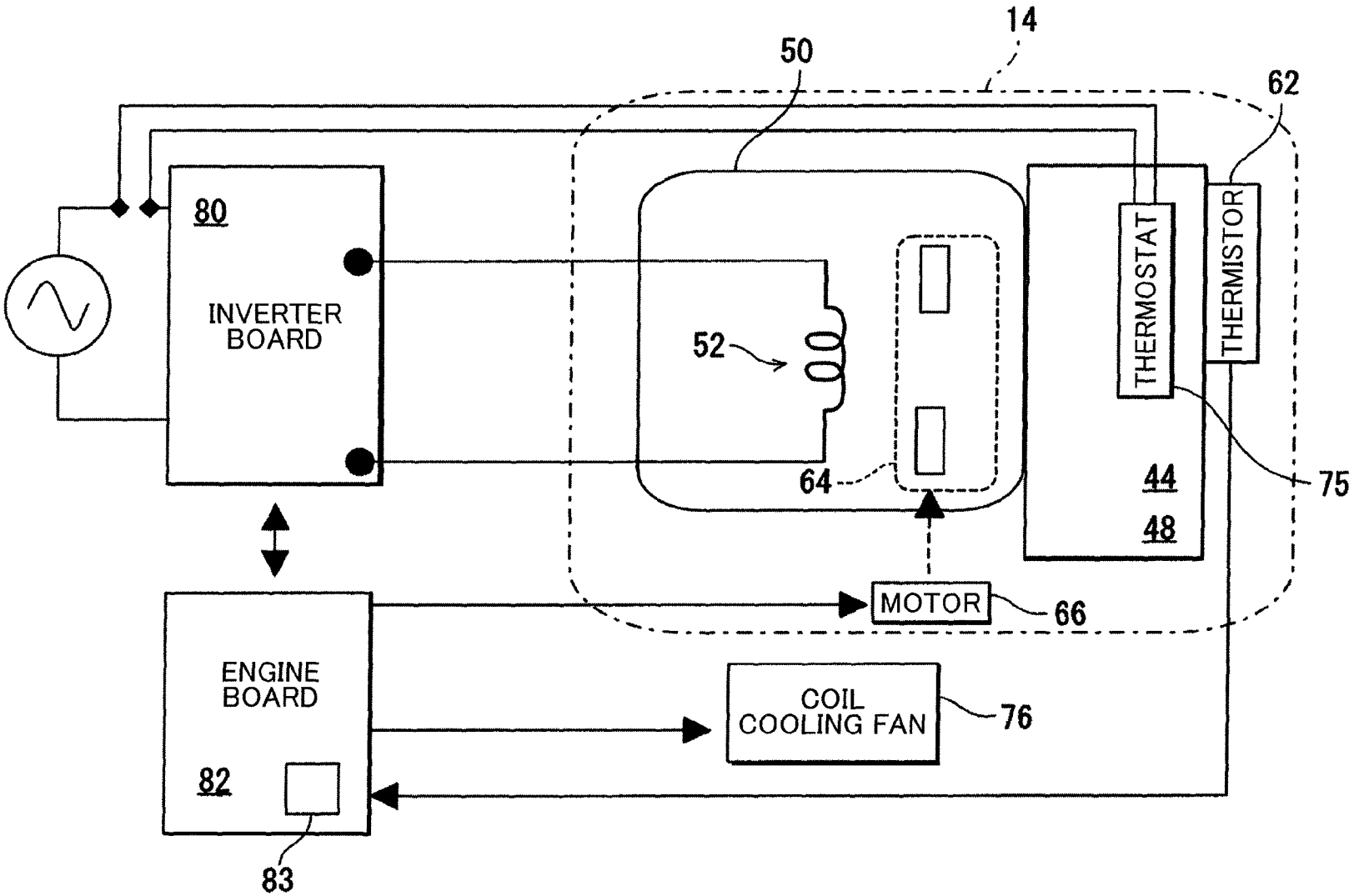
FIG. 5 is a block diagram of the fixing unit.

In the example of FIG. 2, a thermistor 62 (may be a thermostat 75 in FIG. 5) is disposed inside the heat roller 46. The thermistor 62 can be arranged in the interior of the heat roller 46 where the amount of heat generated by induction heating is particularly large. As shown in FIG. 5, the temperature of the heat roller 46 is output to a main body engine board 82. This board 82 is electrically connected to an inverter board 80, and the temperature of the heat roller 46 can be adjusted to be constant by the thermostat 75. This board 80 supplies power to the induction heating coil 52. On the other hand, the coil 52 is appropriately cooled by cooling air from a coil cooling fan 76, and a drive signal for the fan 76 is output from the engine board 82.

The board 82 has a function of driving a rotation mechanism 64 for the center core 58, for example, by outputting a drive signal to a stepping motor 66. Specifically, an angle of rotation of the center core 58 can be controlled by the number of drive pulses applied to the motor 66, and a controller 83 for this purpose belongs to the main body engine board 82. This controller 83 may be, for example, composed of a control IC, an input/output driver, a semiconductor memory and the like. The controller 83, the stepping motor 66 and the rotation mechanism 64 constitute a position switching unit for switching the position of a later-described shielding member between a shielding position and a retracted position.

[Movable Core]

Referring back to FIG. 2, this center core 58 is, for example, a core made of ferrite and having a hollow cylindrical shape. Substantially similar to the heat roller 46, the center core 58 has a length at least corresponding to a maximum sheet width of 13 inches (e.g. about 340 mm). In the case of using such sheets, an alternating current of 20 kHz or higher (alternating frequency of e.g. 30 kHz) is used to avoid an audible zone. Although not shown in FIG. 2, the center core 58 is coupled to the above rotation mechanism 64 and is rotatable about its longitudinal axis by this rotation mechanism 64.

[Shielding Member]

Shielding members 60 are mounted on the center core 58 along its outer surface. Each shielding member 60 is formed into a ring shape by punching inner sides out while leaving only the peripheral edges in the form of a thin plate, and entirely curved into an arcuate shape. The shielding members 60 may be, for example, embedded in the center core 58 as shown or may be bonded to the outer surface of the center core 58. The shielding members 60 can be bonded, for example, using a silicon adhesive.

The material of the shielding members 60 is preferably nonmagnetic and good in electrical conductivity. For example, oxygen-free copper or the like is used. The shielding members 60 shield by generating an opposite magnetic field by induction currents generated by the penetration of a perpendicular magnetic field through the ring parts of the shielding members 60 and canceling an interlinkage magnetic flux (perpendicular penetrating magnetic field). Further, by using a good electrically conductive material, the generation of Joule heat by the induction currents is suppressed and the magnetic fields can be efficiently shielded. In order to improve electrical conductivity, it is effective, for example, (1) to select a material with as small a specific resistance as possible and (2) to increase the thickness of the members. Specifically, the thickness of the shielding members 60 is preferably 0.5 mm or larger and the shielding members 60 having a thickness of 1 mm are, for example, used in this embodiment.

If the shielding members 60 are located at positions (shielding positions) proximate to the outer surface of the heating belt 48 as shown in FIG. 2, magnetic resistance increases around the induction heating coil 52 to reduce magnetic field intensity. On the other hand, if the center core 58 is rotated by 180° (direction is not particularly limited) from the state shown in FIG. 2 and the shielding members 60 are moved to most distant positions (retracted positions) from the heating belt 48, magnetic resistance decreases around the induction heating coil 52 and magnetic paths are formed through the arch cores 54 and the side cores 56 at the opposite sides with the center core 58 as a center, whereby a magnetic field acts on the heating belt 48 and the heat roller 46.

[Basic Construction of the Shielding Member]

Figure 3:
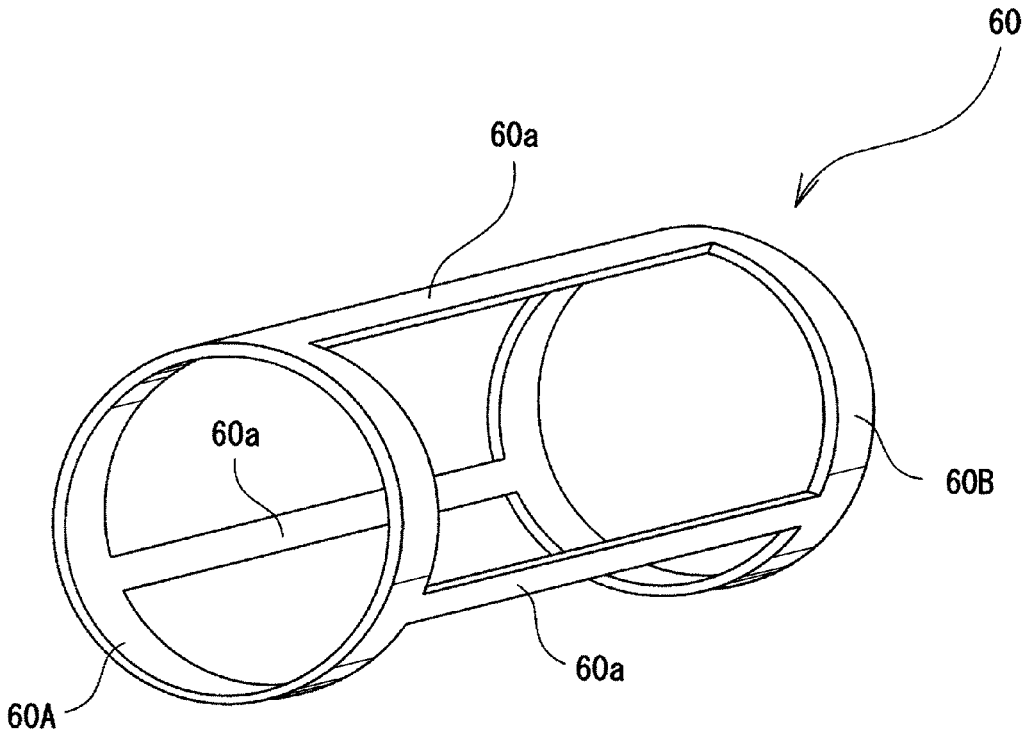
FIG. 3 is a perspective view showing a basic construction of a shielding member.

FIG. 3 is a perspective view showing a basic construction of the shielding member 60 (center core 58 is not shown). This shielding member 60 has a reel-like shape as a whole. Specifically, this shielding member 60 includes an annular portion 60B (first annular portion) and another annular portion 60A (second annular portion) at the opposite longitudinal end positions and these annular portions are connected by three straight portions 60*a*. The straight portions 60*a* are arranged at intervals in a circumferential direction of the annular portions 60B, 60A, and the other annular portion 60A is arranged at one end of the center core 58 (end part of a sheet non-passage area outside a minimum sheet passage area), whereas the annular portion 60B is arranged at a boundary part between the sheet non-passage area and the sheet passage area. Here, the sheet non-passage area (first area) is an area which requires magnetic shielding by the shielding member 60, and the sheet passage area (second area) is an area which does not require magnetic shielding by the shielding member 60. The shielding member 60 is similarly arranged on the unillustrated other end of the center core 58.

In this basic construction, ring parts are formed at three positions in the circumferential direction. Since one ring part is formed by two straight portions 60*a* adjacent in the circumferential direction and the annular portions 60B, 60A connecting these, the shielding member 60 includes three ring parts as a whole. A portion referred to as a ring part in this embodiment is a loop-like frame portion of a rectangular shape when seen in a plan view. The ring part does not mean a circular part in this embodiment.

[Principles of the Magnetic Shielding Effect]

Figure 4A:
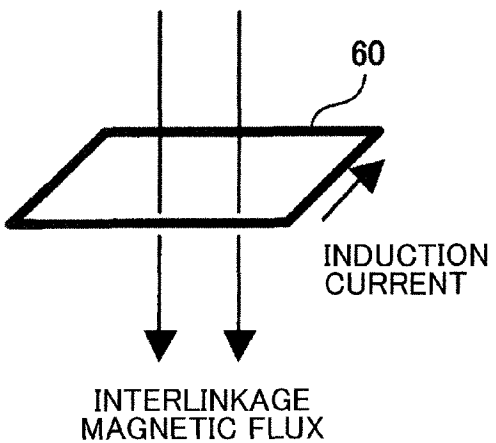
FIGS. 4A to 4C are conceptual diagrams showing principles of magnetic shielding effects by the shielding member.
Figure 4B:
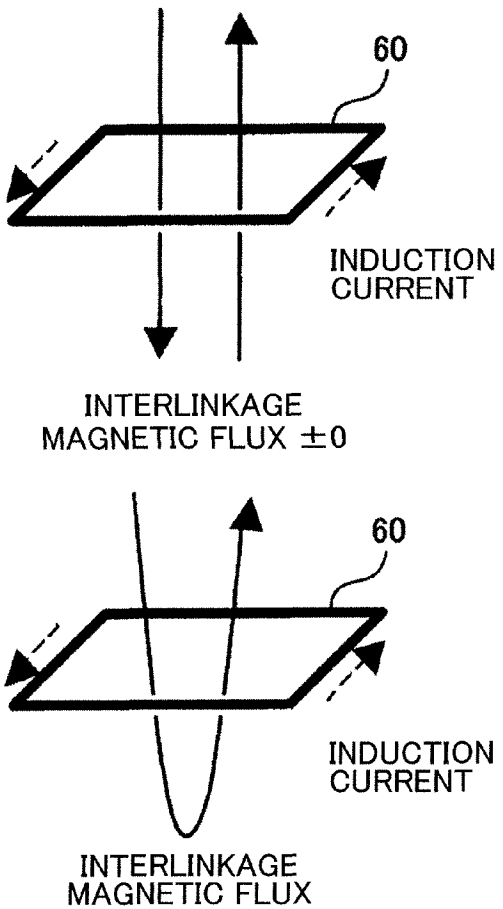
Figure 4C:
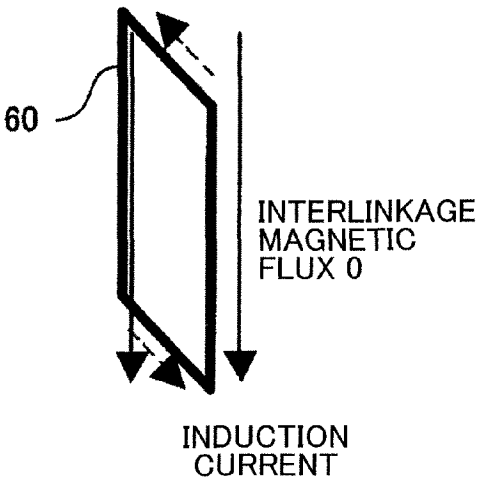

FIGS. 4A to 4C are conceptual diagrams showing principles of the magnetic shielding effect by the shielding member 60. The shielding member 60 in FIGS. 4A to 4C is simply shown as a mere wire model including one ring part.

As shown in FIG. 4A, upon the generation of a magnetic field (interlinkage magnetic flux) penetrating a ring surface (virtual plane) of the ring-shaped shielding member 60 in a perpendicular direction (one direction), an induction current is accordingly generated in the circumferential direction of the shielding member 60. Then, a magnetic field (opposite magnetic field) acting in a direction opposite to the penetrating magnetic field is generated by electromagnetic induction, wherefore these magnetic fields cancel each other to eliminate the magnetic fields. In this embodiment, magnetism is shielded using this magnetic field canceling effect.

A case is assumed where penetrating magnetic fields are generated in two directions through the ring surface of the ring-shaped shielding member 60 as shown in an upper part of FIG. 4B and the sum total of interlinkage magnetic fluxes at this time are substantially 0 (±0). In this case, substantially no induction current is generated in the shielding member 60. Accordingly, the shielding member 60 hardly exhibits its magnetic field canceling effect and the magnetic fields just pass the shielding member 60 in two directions. This similarly holds also in the case where a magnetic field passes the inner side of the shielding member 60 in a U-turn direction as shown in a lower part of FIG. 4B. In this embodiment, the magnetic field is caused to pass by retracting the shielding members 60 to positions where no magnetic field penetrates therethrough in any direction.

FIG. 4C shows a case where a magnetic field (interlinkage magnetic flux) is generated substantially in parallel with the ring surface of the ring-shaped shielding member 60. In this case as well, substantially no induction current is similarly generated in the shielding member 60, wherefore there is no magnetic field canceling effect. This is a retraction technique mainly used in prior arts although not employed in this embodiment. The shielding member 60 needs to be largely displaced to obtain such a magnetic field environment around the induction heating coil 52 and, accordingly, a movable space becomes larger.

The inventors of the present invention paid attention to the point that the magnetic shielding effect is obtained by the principle shown in FIG. 4A, and optimal magnetic shielding is performed by displacing the shielding members 60 between the shielding positions and the retracted positions.

[Operation of the Shielding Member]

Figure 6B:
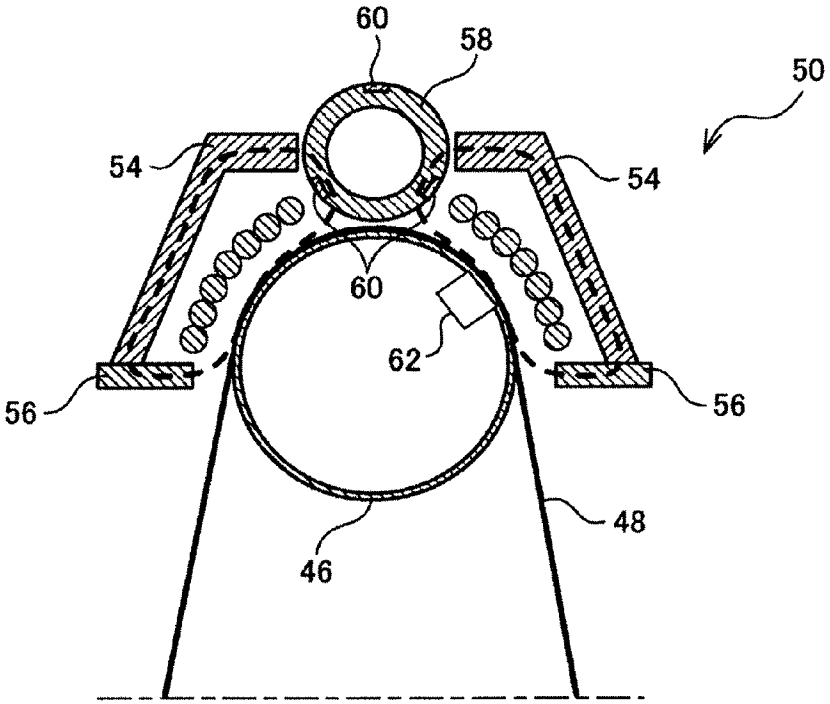
FIGS. 6A and 6B are diagrams showing operation examples using the shielding member with the basic construction.
Figure 6A:
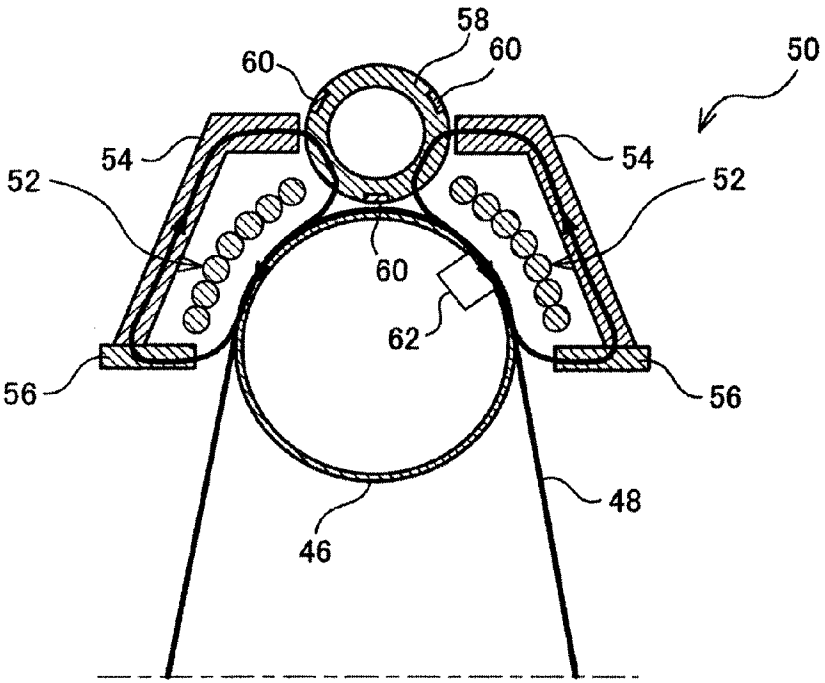

FIGS. 6A and 6B are diagrams showing operation examples using the shielding members 60 with the basic construction according to the rotation of the center core 58.

FIG. 6A shows the operation example in the case of switching the shielding members 60 to the retracted positions according to the rotation of the center core 58. In the case of the basic construction, the principle shown in the lower part of FIG. 4B is applied with the shielding members 60 retracted. Specifically, by positioning one of the three straight portions 60*a* on a winding center line of the coil 52, one ring part located at a side (upper side in FIG. 6A) opposite to the heat roller 46 is retracted to the outside of magnetic fields and the magnetic fields are permitted to pass in a U-turn direction through the inner sides of the other two ring parts, thereby realizing a state where no magnetic shielding effect is generated. Accordingly, the magnetic fields reaches the heating belt 48 and the heat roller 46 through the vicinity of the winding center line of the coil 52 via the side cores 56, the arch cores 54 and the center core 58. At this time, eddy currents are generated in the heating belt 48 and the heat roller 46 that are ferromagnetic bodies, and Joule heat is generated by the specific resistances of the respective materials for heating.

FIG. 6B shows the operation example in the case of switching the shielding members 60 to the shielding positions. In this case, one ring part of each shielding member 60 is located on a magnetic path outside the minimum sheet passage area and a magnetic field penetrates through the inside of this ring part, specifically, the ring surface of this ring part. Thus, the generation of the magnetic field is partially suppressed by the principle shown in FIG. 4A. In this way, the amount of heat generated outside the minimum sheet passage area is suppressed and excessive temperature increases of the heating belt 48 and the heat roller 46 can be prevented.

CONSTRUCTIONAL EXAMPLE (1) OF THE SHIELDING MEMBER

Figure 7:
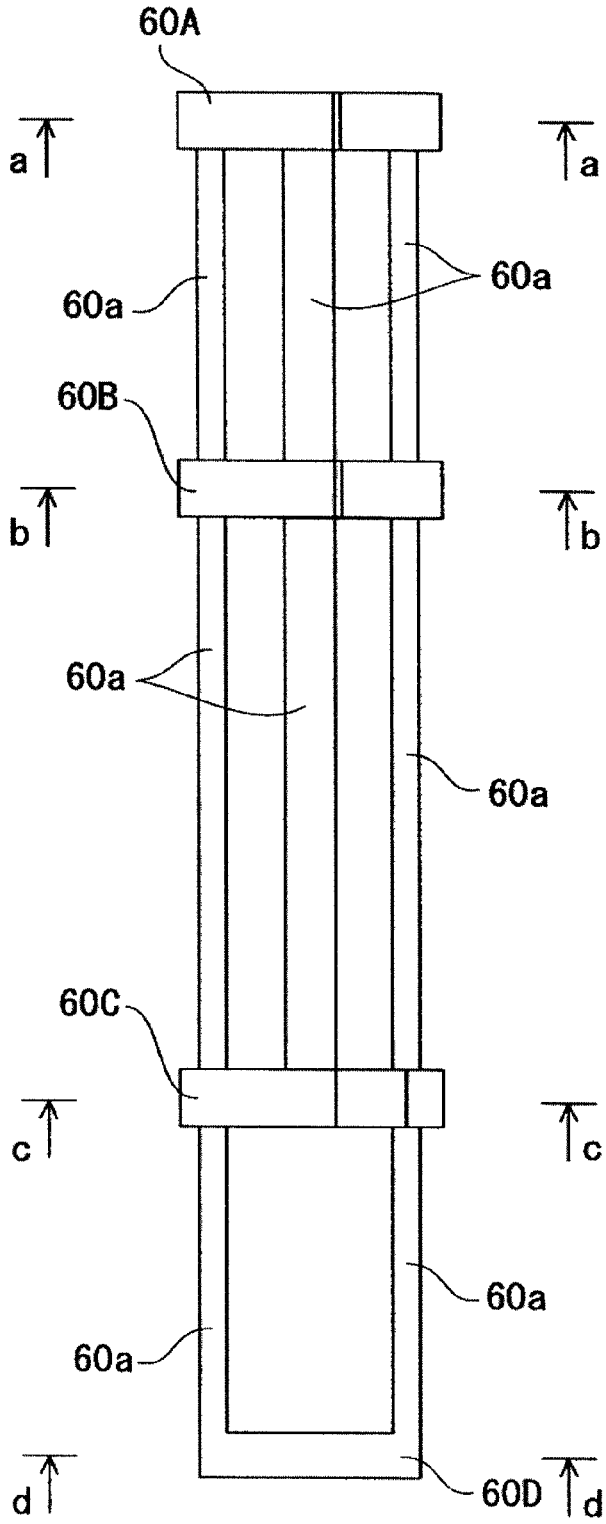
FIG. 7 is a plan view of the shielding member.

FIG. 7 is a plan view showing a constructional example (1) of the shielding member 60 (center core 58 is not shown), and FIGS. 8A to 8D correspond to sections along a-a, b-b, c-c and d-d of FIG. 7. The shielding member 60 of this constructional example (1) is a development of the basic construction. Specifically, in the constructional example (1), the shielding member 60 includes the annular portion 60A located at one longitudinal end position, the annular portion 60B spaced apart from the annular portion 60A in the longitudinal direction, an arcuate portion 60C having a substantially ⅔ circular cross section and following the annular portion 60B in the longitudinal direction, and an arcuate portion 60D having a substantially ⅓ circular cross section at the other end position.

More specifically, the annular portion 60A most distant from the minimum sheet passage area is located at a position corresponding to a maximum size P 1 (e.g. A3 or A4R); the annular portion 60B at a position corresponding to a middle size P2 (e.g. B4R); and the arcuate portion 60C at a position corresponding to a middle/small size P3 (e.g. B4). The arcuate portion 60D near the minimum sheet passage area is at a position corresponding to a minimum size P4 (e.g. A5R).

Out of these four, i.e. the annular portions 60A, 60B and the arcuate portions 60C, 60D, three, i.e. the annular portions 60A, 60B and the arcuate portion 60C are connected to each other via three straight portions 60*a*. The remaining arcuate portion 60C at the other end position is connected to the adjacent arcuate portion 60C via two straight portions 60*a*. These respective straight portions 60*a* are arranged on the same straight lines.

These annular portions 60A, 60B, arcuate portions 60C, 60D and straight portions 60*a* are formed in the form of one plate, and are mounted while being rounded along the outer surface of the center core 58. The cross sections of the annular portions 60A, 60B and the arcuate portions 60C, 60D are shown in FIGS. 8A to 8D. First of all, an upper end 60*v* and a right end 60*w* of the arcuate portion 60C corresponding to the middle/small size P3 are spaced apart, and a left end 60*x* and a right end 60*y* of the arcuate portion 60D corresponding to the minimum size P4 are also spaced apart.

On the contrary, each of the annular portion 60A corresponding to the maximum size P1 and the annular portion 60B corresponding to the middle size P2 includes an upper end 60*s* and a lower end 60*t* overlapping in a vertical direction and, hence, is closed in the circumferential direction. The annular portion 60B is arranged at a boundary part between the sheet non-passage area (outside the middle size P2) and the sheet passage area (inside the middle size P2) of the middle size P2, and a circumferential part thereof is electrically insulated when viewed in an axial direction.

Figure 8A:
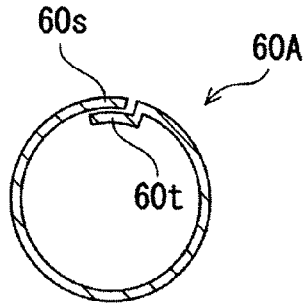
FIG. 8A is a section along a-a of FIG. 7.
Figure 8B:
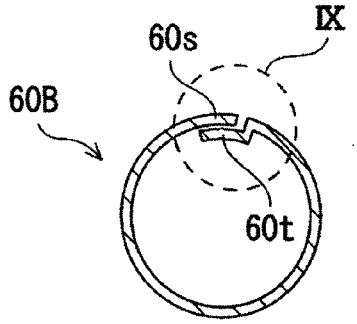
FIG. 8B is a section along b-b of FIG. 7.
Figure 8C:
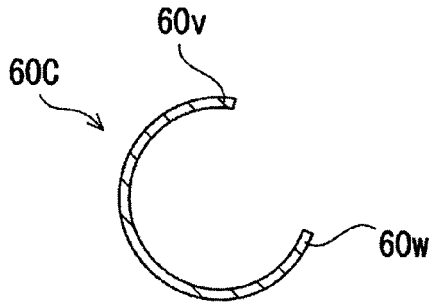
FIG. 8C is a section along c-c of FIG. 7.
Figure 8D:
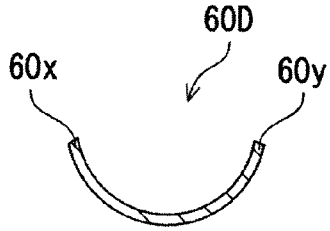
FIG. 8D is a section along d-d of FIG. 7.
Figure 9:
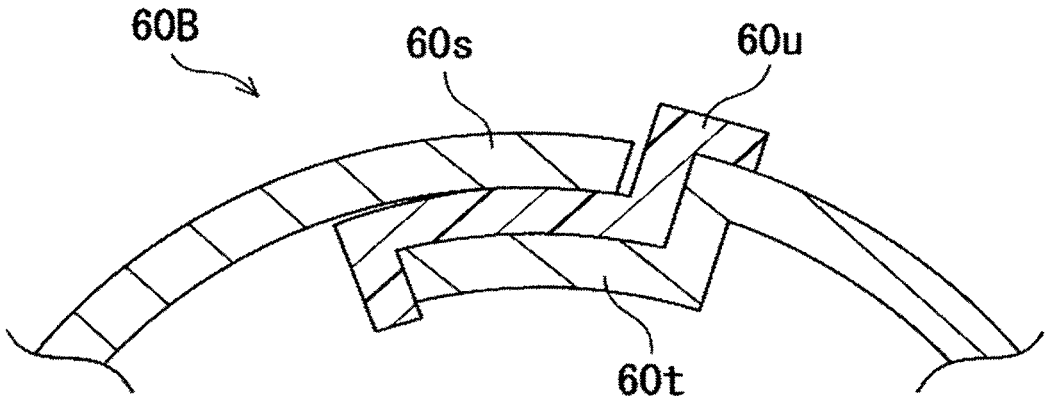
FIG. 9 is a partial enlarged view of FIG. 8B.

Specifically, as shown in FIG. 9 as a partial enlarged view of FIG. 8B, a heat resistant insulating film (electrically insulating member) 60*u* is interposed between the lower surface of the upper end (one end) 60*s* and the upper surface of the lower end (other end) 60*t*, whereby electrical connection is cut while the annular shape is retained. Besides this insulating film, the lower surface of the upper end 60*s* and the upper surface of the lower end 60*t* may be covered with an insulating tube made of PFA, a kapton film or the like. Alternatively, a clearance of about 0.5 to 1 mm may be, for example, provided between the upper end 60*s* and the lower end 60*t*. In this case, enamel coating or polyamide-imide coating is preferably applied. The shielding member 60 is affected not only by self-generated heat, but also by heat generated by the coil 52 and radiation heat from the heating belt 48 and the like.

Although the annular portion 60A is also formed with the upper end 60*s* and the lower end 60*t* similar to the annular portion 60B, but its electrical connection may be not cut.

FIGS. 10A to 10D are diagrams showing a state where the shielding member 60 of the constructional example (1) is mounted on the center core 58. FIG. 10 corresponds to a plan view and a side view of the center core 58, FIGS. 10B, 10C and 10D correspond to sections along B-B, C-C and D-D of FIG. 10A. The shielding member 60 is mounted on the center core 58 by insert molding, and small outer surfaces of the annular portions 60A, 60B and the arcuate portions 60C, 60D are exposed on the outer circumferential surface of the center core 58. For the sake of convenience, the upper ends 60*s*, the lower ends 60*t*, the insulating film 60*u* and the like are not shown in FIGS. 10B to 10D.

As shown in FIG. 10A, the shielding member 60 of the constructional example (1) is also provided at a longitudinal end of the center core 58. At this time, the annular portion 60A most distant from the minimum sheet passage area is located at a position corresponding to the maximum size P1 (e.g. A3, A4R); the annular portion 60B at a position corresponding to the middle size P2 (e.g. B4R); and the arcuate portion 60C at a position corresponding to the middle/small size P3 (e.g. B4). The arcuate portion 60C near the minimum sheet passage area is located at a position corresponding to the minimum size P4 (e.g. A5R).

As shown in FIG. 10B, the annular portions 60A, 60B are shaped to have a center hole. Further, as shown in FIG. 10C, the arcuate portion 60C is shaped to have a substantially ⅔ circular cross section, and the ferrite material of the center core 58 is filled in a lacking part of the arcuate portion 60C.

Further, as shown in FIG. 10D, the arcuate portion 60D is shaped to have a substantially ⅓ circular cross section, and the ferrite material of the center core 58 is also filled in a lacking part of the arcuate portion 60C.

OPERATION OF THE CONSTRUCTIONAL EXAMPLE (1)

Next, an operation example in the case of employing the shielding member 60 of the constructional example (1) is described. FIGS. 11 to 16 are perspective views successively showing six operation examples using the shielding member 60 of the constructional example (1). Thick-line arrows shown indicate generated induction currents or passing magnetic fields. The respective operation examples are described below.

[Complete Shielding (0°)]

Figure 11:
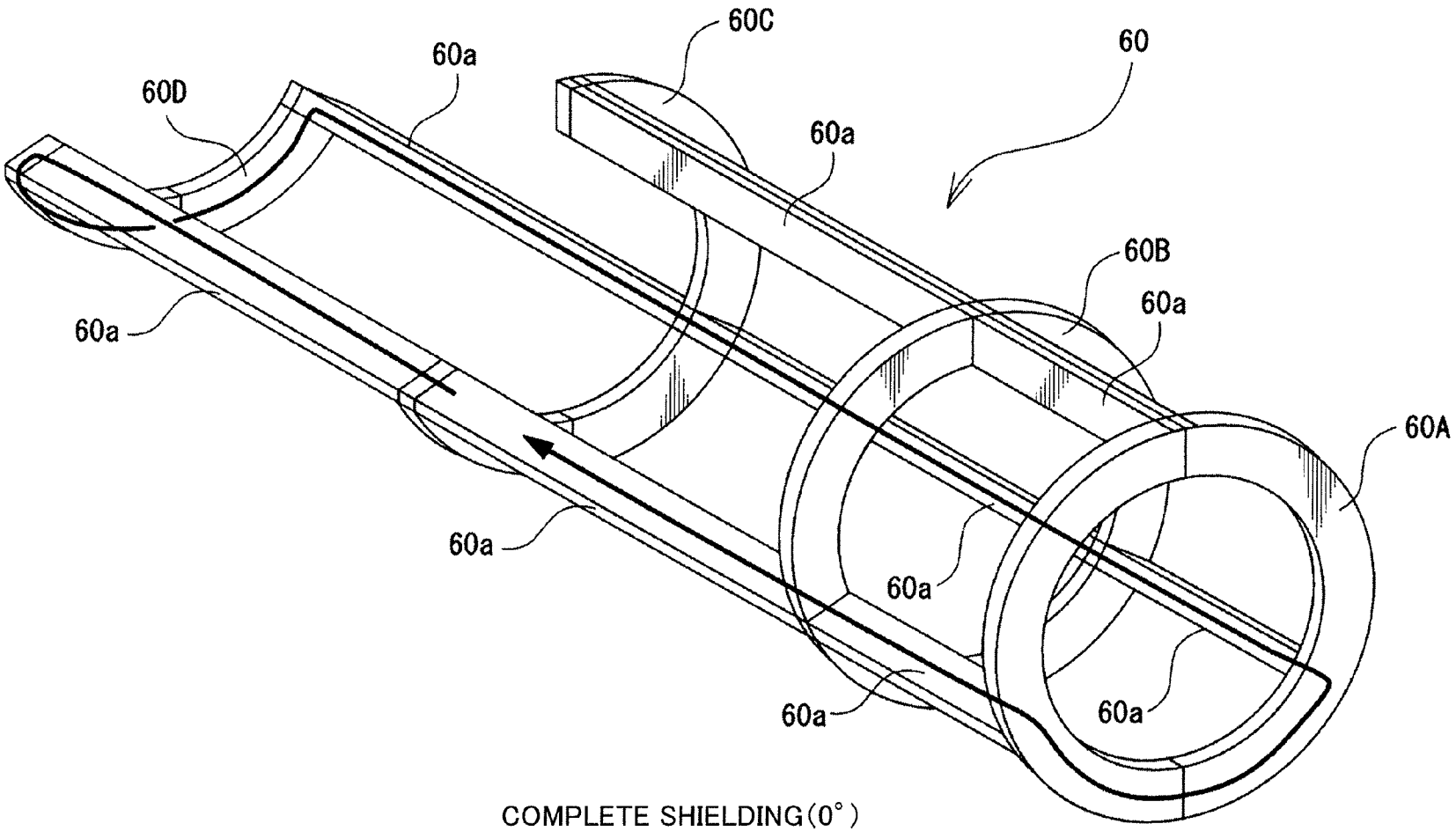
FIGS. 11 to 16 are perspective views showing operation examples of the shielding member.

First of all, FIG. 11 is the perspective view showing an operation example in the case of complete shielding by the shielding member 60. It is assumed in each operation example that a magnetic field is generated in such a direction as to penetrate the shielding member 60 from upper side to lower side. In the following description, it is assumed that a state of complete shielding shown in FIG. 11 is 0° and a displacement amount of the shielding member 60 is expressed by an angle of rotation from 0°.

If the shielding member 60 is moved to an angle of rotation (0°) at which the arcuate portion 60D is located at the bottom, the magnetic shielding effect can be exhibited by the entire surface of the shielding member 60 in the longitudinal direction. In other words, since a maximum ring part is formed by the annular portion 60A at the one end position, the arcuate portion 60D at the other end position and the straight portions 60*a* connecting these, the shielding member 60 can shield magnetism in its entirety. In this case, the overheating of the heating belt 48 and the heat roller 46 can be prevented in correspondence with the minimum size P4.

In the case of this minimum size P4, the magnetic field shielded between the annular portions 60A and 60B is not canceled and can reach the heating belt 48 and the heat roller 46, for example, from a side more inward than the arcuate portion 60D when viewed from the annular portion 60B via the interior of the center core 58 since no induction current is generated in the annular portion 60B.

[No Shielding (60°)]

Figure 12:
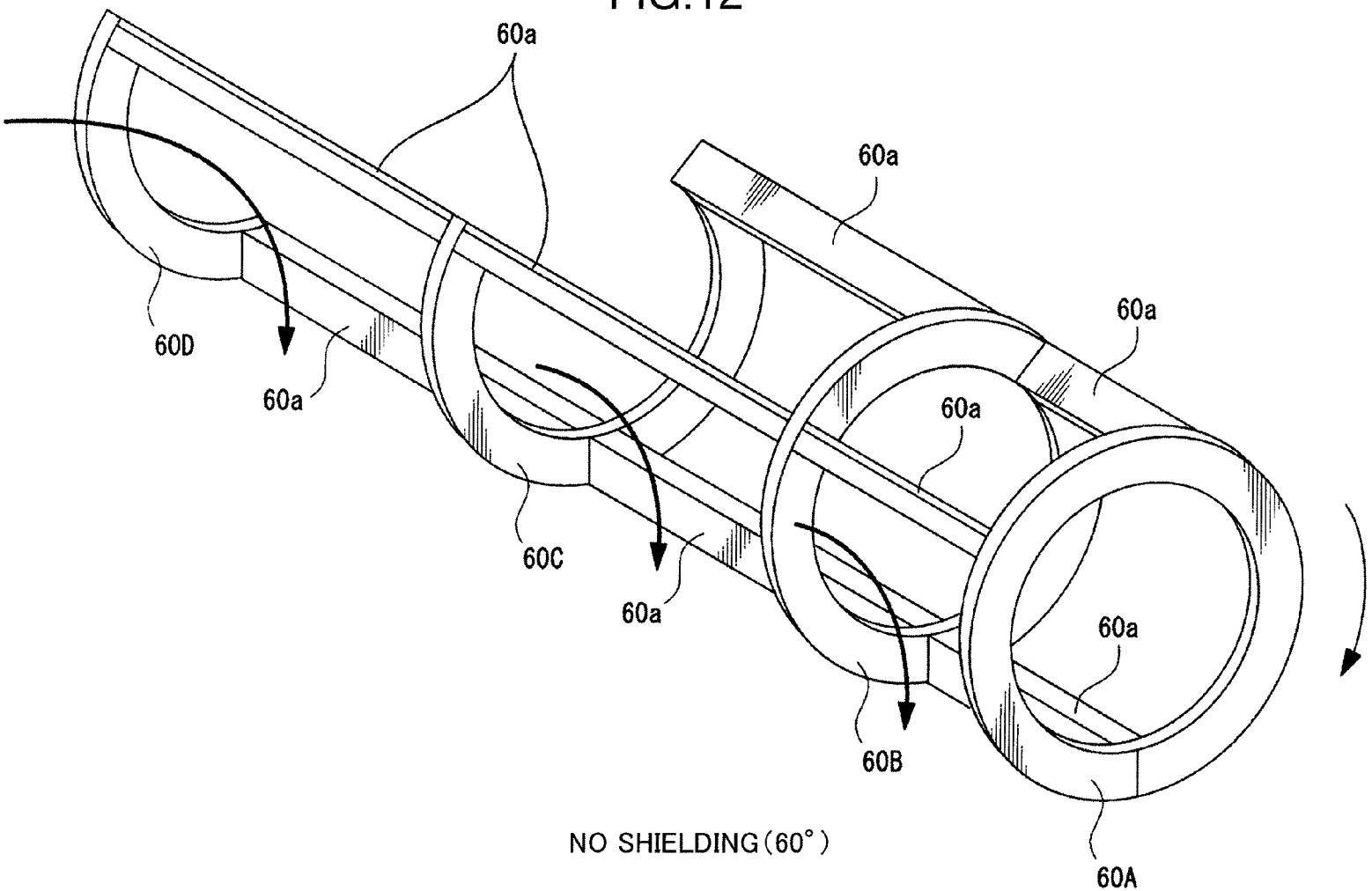

FIG. 12 is the perspective view showing an operation example when the shielding member 60 is rotated in the clockwise direction by 60° from the state of FIG. 11. In this case, since the straight portion 60*a* is located on the center line of the coil 52 (state of FIG. 6A), the shielding member 60 is at the retracted position and exhibits no magnetic shielding effect.

[Middle-Small Size Shielding (120°)]

Figure 13:
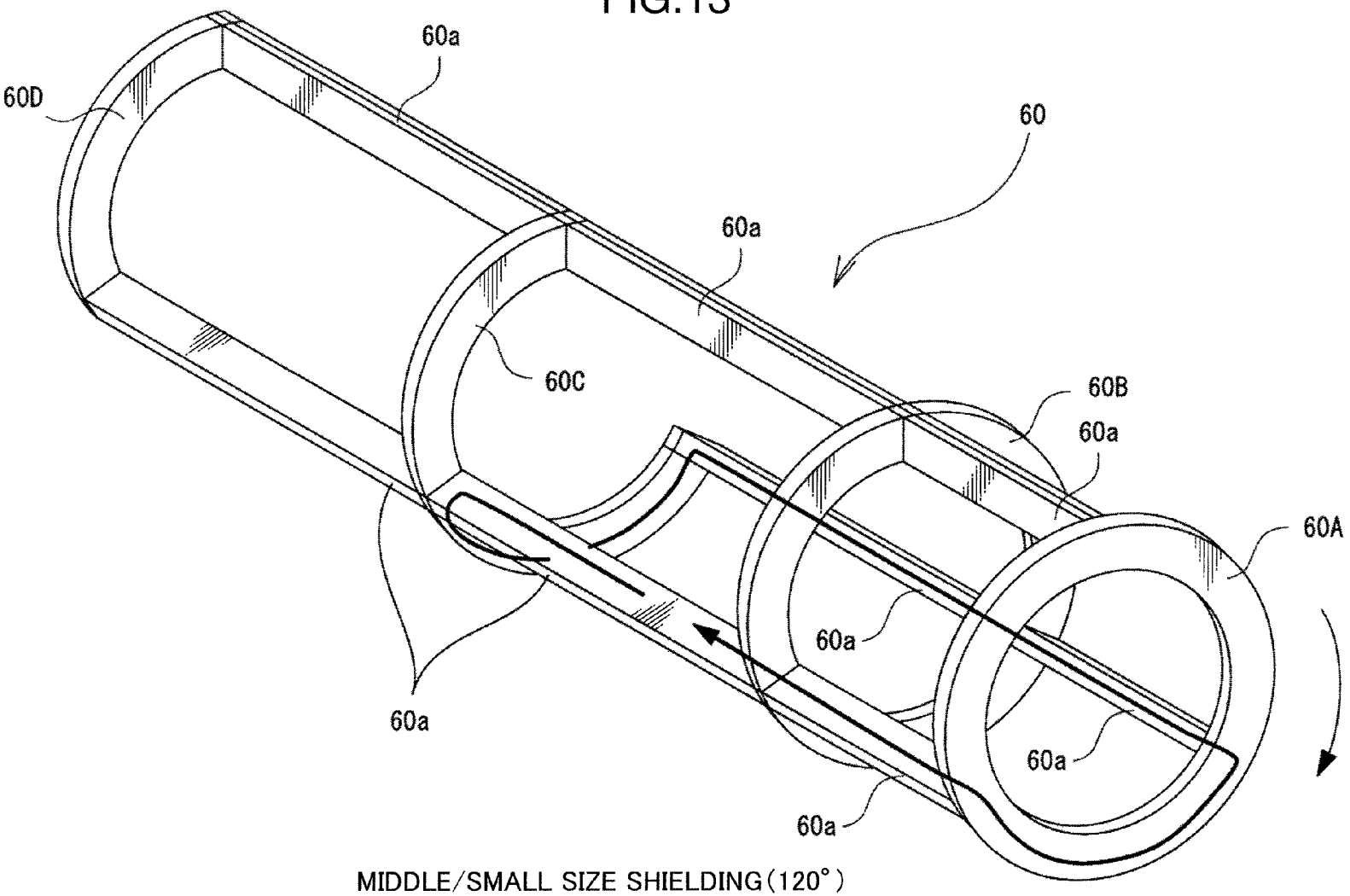

FIG. 13 is the perspective view showing an operation example when the shielding member 60 is rotated in the clockwise direction by 120° from the state of FIG. 11. In this case, the magnetic shielding effect is exhibited by one ring part formed between the annular portion 60A and the arcuate portion 60C. In this operation example, the overheating of the heating belt 48 and the heat roller 46 can be prevented, for example, in correspondence with the middle-small size P3.

Also in the case of this middle/small size P3, the magnetic field shielded between the annular portions 60A and 60B is not canceled and can reach the heating belt 48 and the heat roller 46, for example, from a space between the arcuate portions 60C and 60D via the interior of the center core 58.

[No Shielding (180°)]

Figure 14:
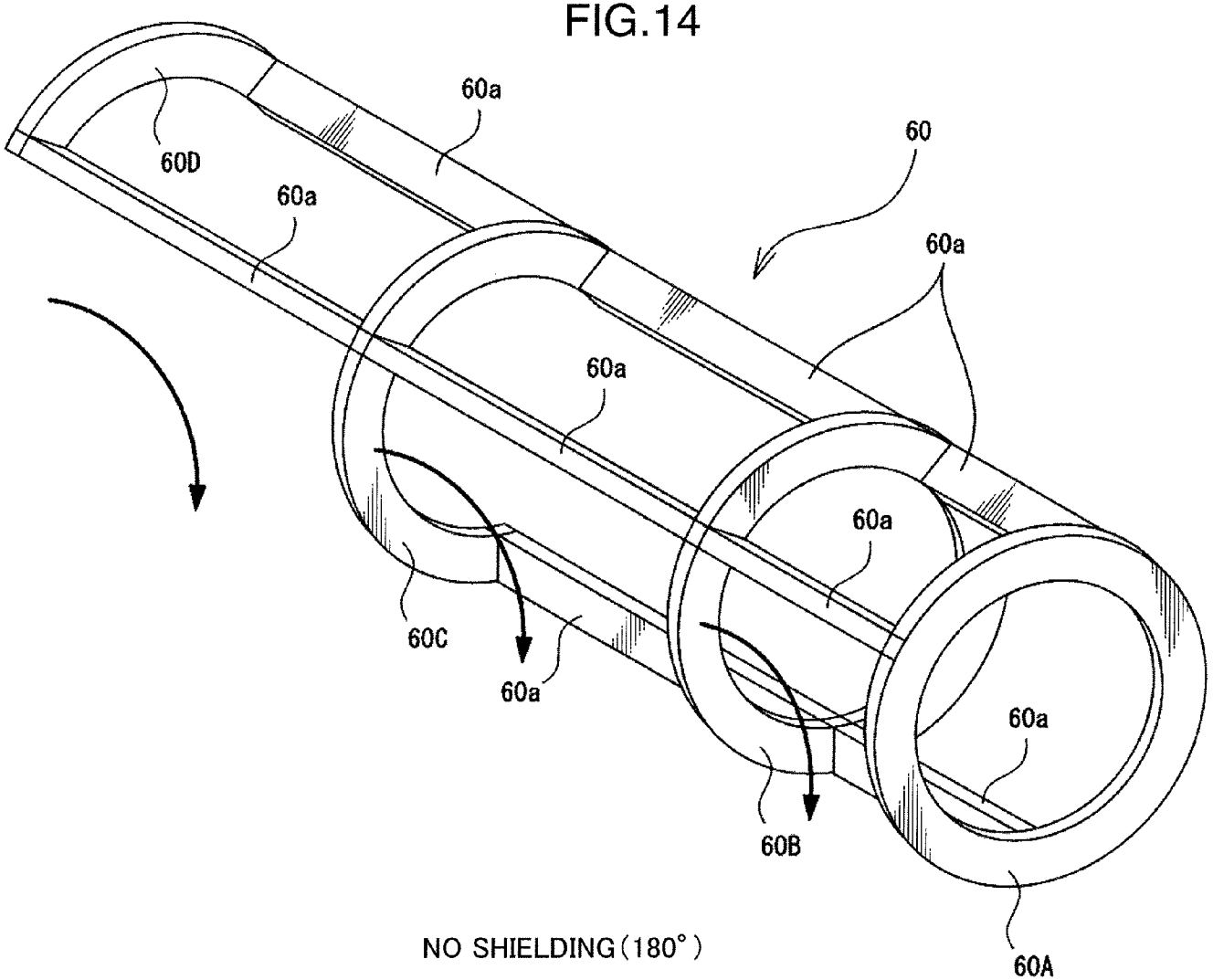

FIG. 14 is the perspective view showing an operation example when the shielding member 60 is rotated in the clockwise direction by 180° from the state of FIG. 11. In this case, since the straight portion 60*a* is located on the center line of the coil 52 (state of FIG. 6A) as in FIG. 12, the shielding member 60 is at the retracted position and exhibits no magnetic shielding effect.

[Middle Size Shielding (240°)]

Figure 15:
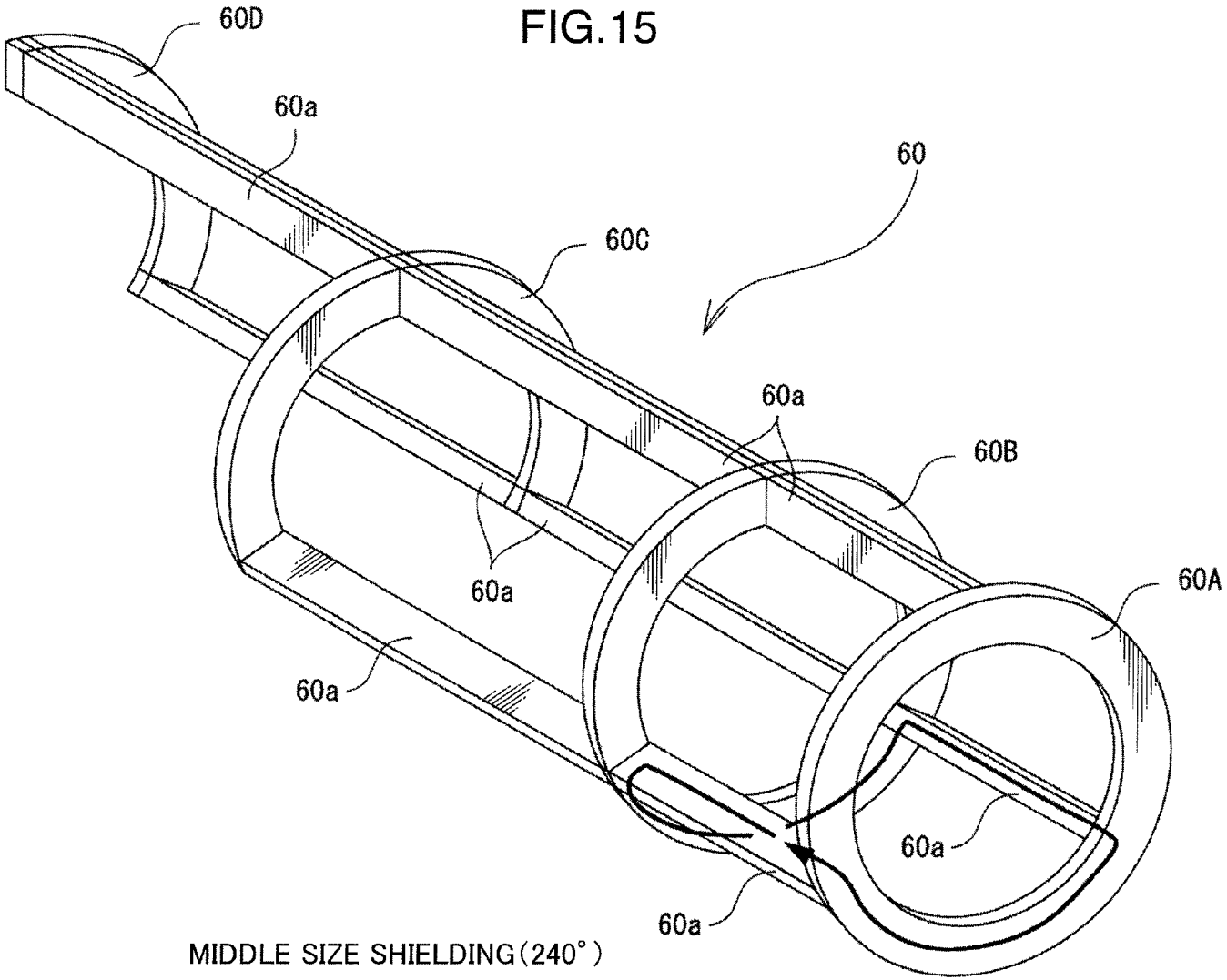

FIG. 15 is the perspective view showing an operation example when the shielding member 60 is rotated in the clockwise direction by 240° from the state of FIG. 11. In this case, one ring part formed between the annular portions 60A and 60B can exhibit the magnetic shielding effect. In this operation example, the overheating of the heating belt 48 and the heat roller 46 can be prevented, for example, in correspondence with the middle size P2.

Also in the case of this middle size P2, the magnetic field shielded between the annular portions 60A and 60B is not canceled and can reach the heating belt 48 and the heat roller 46, for example, from a space between the annular portion 60B and the arcuate portion 60C via the interior of the center core 58.

[No Shielding (300°)]

Figure 16:
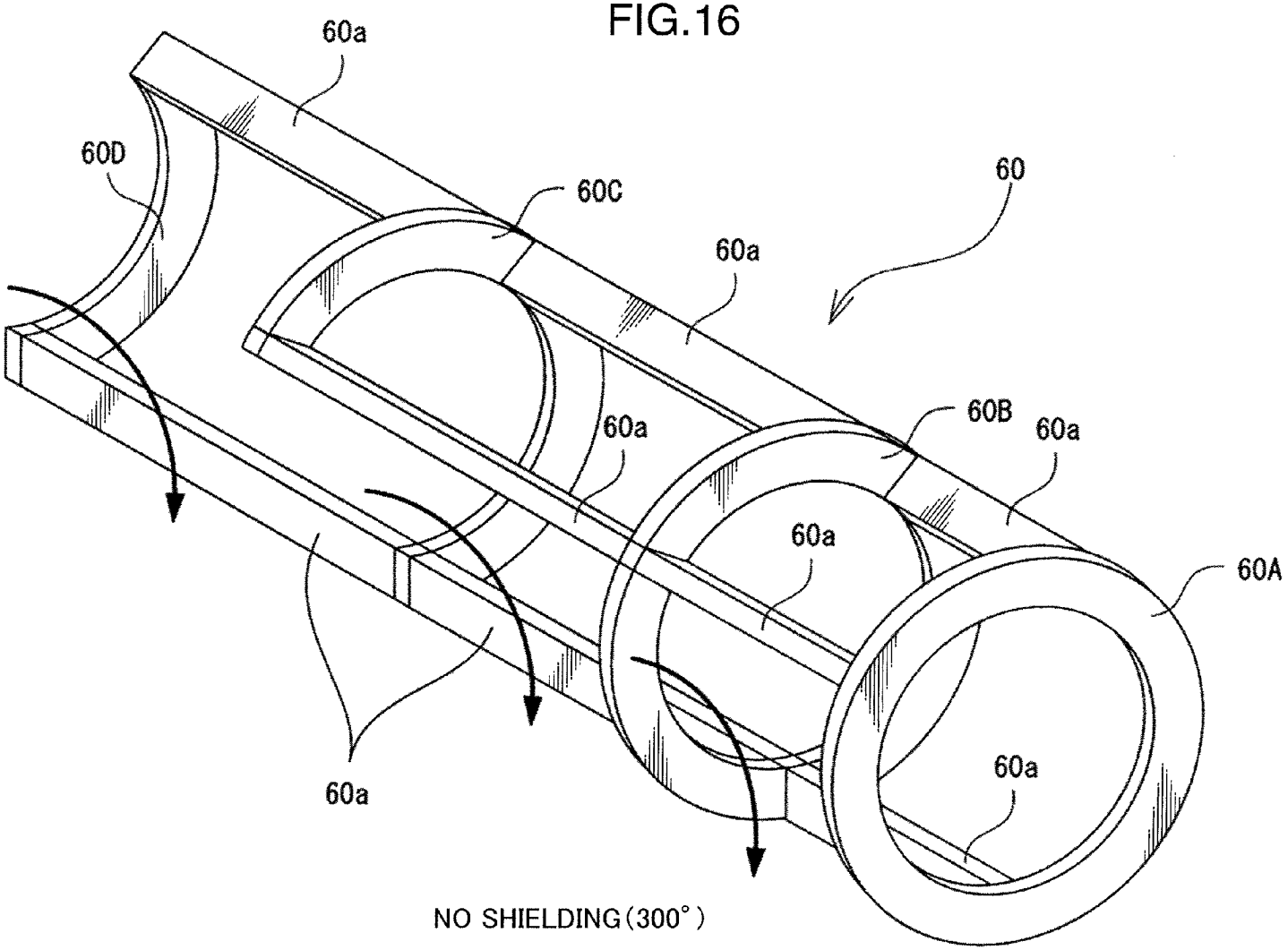

FIG. 16 is the perspective view showing an operation example when the shielding member 60 is rotated in the clockwise direction by 300° from the state of FIG. 11. In this case, since the straight portion 60*a* is located on the center line of the coil 52 (state of FIG. 6A) as in FIGS. 12 and 14, the shielding member 60 is at the retracted position and exhibits no magnetic shielding effect. In the case of no shielding (60°), (180°) and (300°), the heating belt 48 and the heat roller 46 can be heated by induction in correspondence with the maximum size P1.

OTHER CONSTRUCTIONAL EXAMPLES OF THE FIXING UNIT

Figure 17:
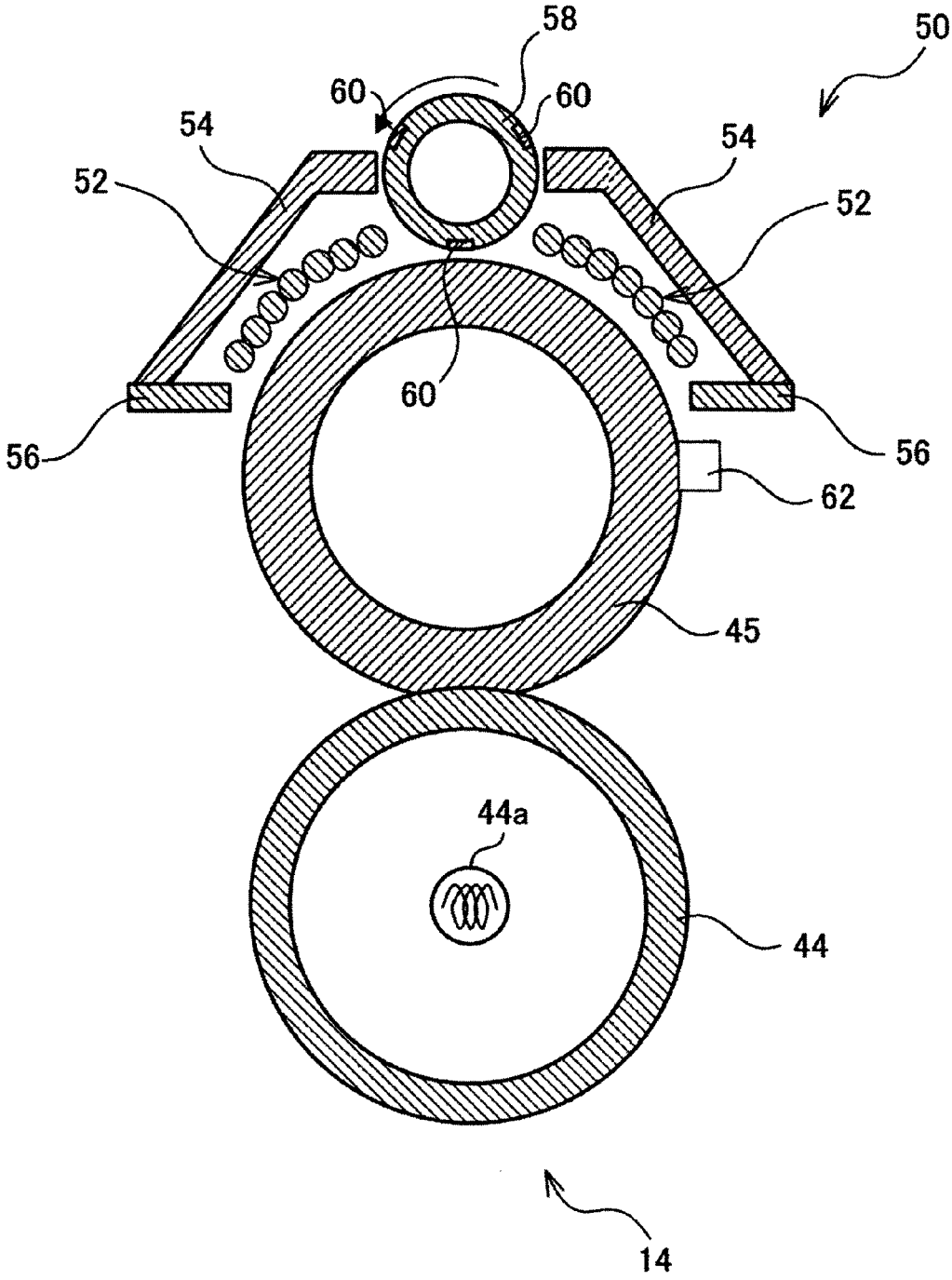
FIG. 17 is a diagram showing another constructional example of the fixing unit.

FIG. 17 is a diagram showing another constructional example of the fixing unit 14. In this constructional example, a toner image is fixed by the fixing roller 45 and the pressing roller 44 without using the above heating belt. A magnetic body similar to the above heating belt is, for example, wound around the outer circumferential surface of the fixing roller 45, and the magnetic body is induction heated by the induction heating coil 52. In this case, the thermistor 62 is disposed at a position outside the fixing roller 45 to face a magnetic body layer. The other construction is similar to the above and the shielding members 60 can be moved to the shielding positions and the retracted positions by rotating the center core 58.

Figure 18:
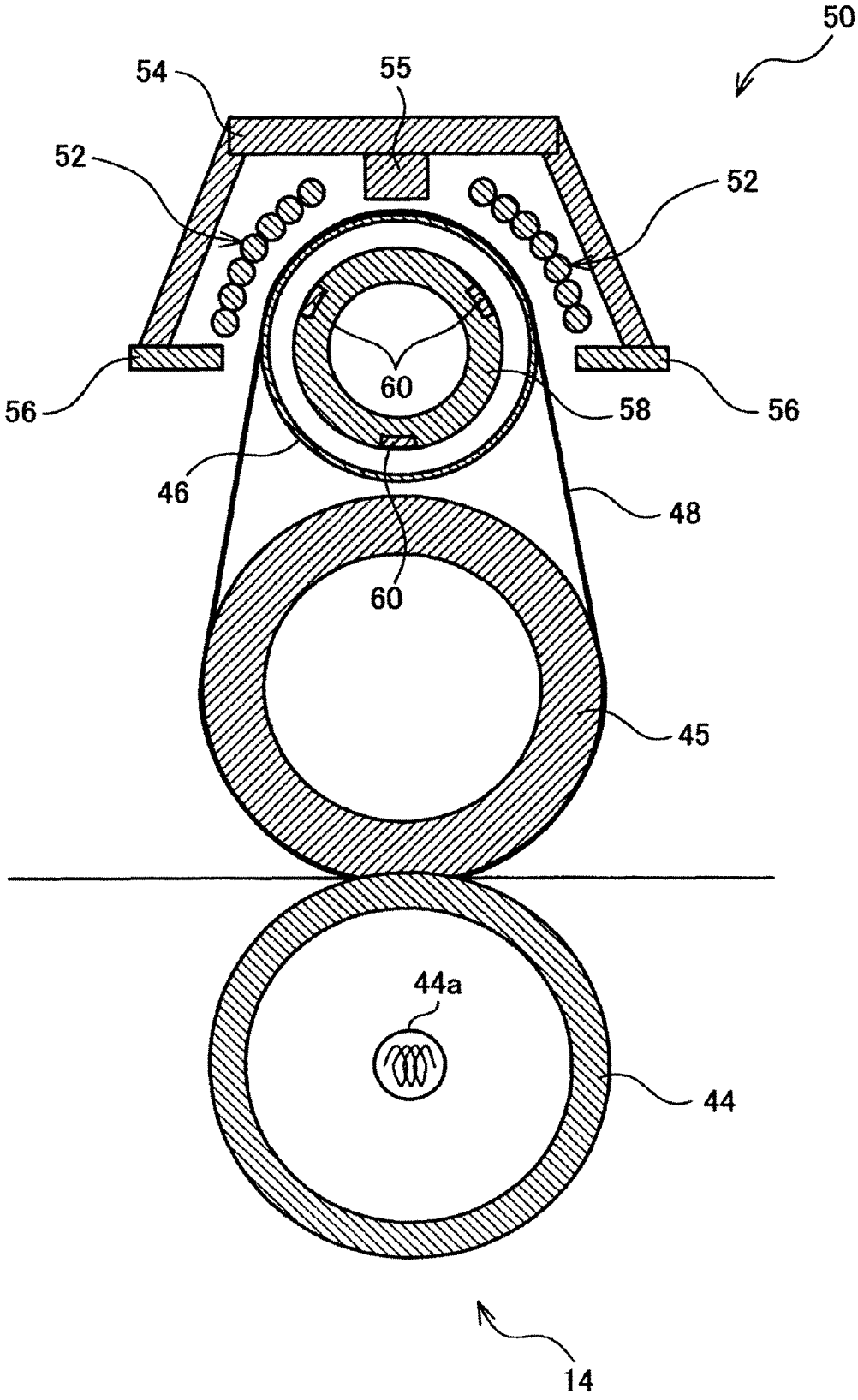
FIG. 18 is a diagram showing still another construction example of the fixing unit.

FIG. 18 is a vertical section showing still another construction example of the fixing unit 14. This constructional example differs from the above examples in that the heat roller 46 is made of a nonmagnetic metal (e.g. SUS: stainless steel) and the center core 58 and the shielding members 60 are arranged inside the heat roller 46. In addition, the arch cores 54 are connected in the center and an intermediate core 55 is disposed below the connected part.

If the heat roller 46 is made of the nonmagnetic metal, the magnetic field generated by the induction heating coil 52 passes the side cores 56, the arch cores 54 and the intermediate core 55 and reaches the center core 58 inside after penetrating through the heat roller 46. The heating belt 48 is induction heated by the penetrating magnetic field. In such a constructional example, if the ring parts of the shielding members 60 are switched to positions (shielding positions) to face the intermediate core 55 as shown in FIG. 18, magnetism is shielded to suppress an excessive temperature increase outside the sheet passage area. On the other hand, if the shielding members 60 are at the retracted positions where magnetism does not penetrate through the insides of the ring parts of the shielding members 60, the magnetic shielding effect does not work and the heating belt 48 is induction heated in the maximum sheet passage area in this case.

Figure 19:
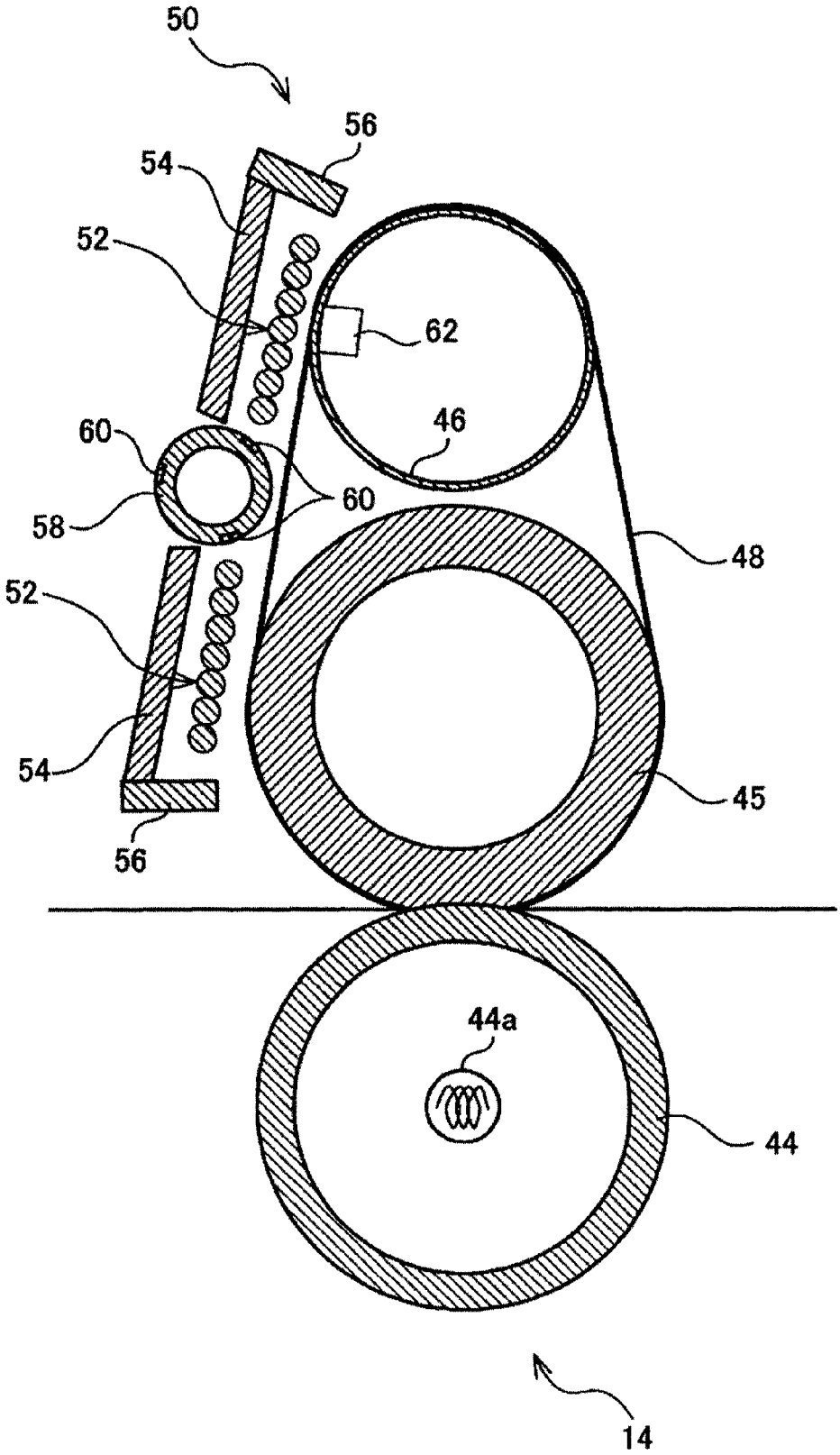
FIG. 19 is a diagram showing further another construction example of the fixing unit.

Next, in a constructional example of FIG. 19, induction heating is performed not at a position facing the arcuate part of the heating belt 48, but at a position facing a flat part of the heating belt 48 between the heat roller 46 and the fixing roller 45. In this case as well, the magnetism can be similarly shielded by rotating the center core 58.

As described above, since the heating belt 48 is induction heated by the magnetic field generated by the coil 52 to heat and melt the toner image according to this embodiment, no special member needs to be arranged inside the heating belt 48 in the case of employing an external IH method by arranging the coil 52, for example, outside the heating belt 48. The arch cores 54 and the side cores 56 are arranged around the coil 52 to form magnetic paths for guiding the magnetic fields generated by the coil 52, the center core 58 is merely disposed between the cores 54, 56 and the belt 48, and the shielding members 60 for shielding magnetism surround the center core 58. Thus, the shielding members 60 need not be arranged at a position different from the core 58 and, accordingly, a space taken up by the fixing unit as a whole is not inadvertently enlarged.

Particularly in this embodiment, when the shielding members 60 surrounding the center core 58 are moved to the retracted positions, the magnetic fields generated by the coil 52 are guided to the cores 54, 55 and 58 and generate an eddy current in the heating belt 48 for magnetic induction heating. On the other hand, when the shielding members 60 are moved to the shielding positions, magnetoresistance in the magnetic paths increases to reduce magnetic field intensity, whereby the amount of heat generated by the belt 48 can be reduced. Accordingly, the center core 58 needs not be moved away from the heating member upon adjusting the amount of heat generated by the heating belt 48 and space saving is improved by that much. Further, in the case of employing the external IH construction, it can contribute to a reduction in warm-up time by suppressing an increase in heat capacity since cores for magnetic induction and a conductive member for magnetic field adjustment need not be arranged inside the heating belt 48.

The shielding member 60 of this embodiment has the following merits. Specifically, since the shielding member 60 is ring-shaped, when a magnetic field (interlinkage magnetic flux) penetrates the ring surface of the ring part in a direction perpendicular to the ring surface, an induction current is generated in a ring circumferential direction and an opposite magnetic field in a direction opposite to the penetrating magnetic field is generated from there. This opposite magnetic field cancels the above interlinkage magnetic flux, whereby the shielding member 60 can shield magnetism. On the other hand, no induction current is generated and no magnetic shielding effect is exhibited if magnetic fields penetrate through the ring surface of the ring part in two directions such as the passage of magnetic fields through the ring surface of the ring part in two opposite directions and U-turn passage of a magnetic field.

The controller 83 can move the shielding members 60 by rotating the center core 58 about the axis intersecting with the magnetic field passing direction. In other words, in the present invention, the shielding members 60 can be freely moved to the shielding positions and the retracted positions only by rotating the center core 58. Thus, the mechanism for moving the shielding members 60 is simplified and this point also contributes to space saving.

Further, as described in this embodiment, the annular portion 60B located at the boundary part between the sheet non-passage area and the sheet passage area of the middle size P2 is a constituent element for three ring parts for shielding magnetism in a magnetic field generated by the coil 52. The annular portion 60B is closed in its circumferential direction. On the other hand, the annular portion 60B is electrically insulated when viewed in the axial direction. Thus, the annular portion 60B itself is not perfectly conductive. Therefore, in the case of a sheet of the middle size P2, magnetic fields shielded in the sheet non-passage areas at the time of shielding magnetism by the shielding members 60 are not canceled by opposite magnetic fields from induction currents. Hence, the magnetic fields can reach the sheet passage area via the center core 58 extending in the longitudinal direction and complete magnetic shielding in the sheet non-passage areas is possible. This results in a contribution to a further improvement in the magnetic shielding effect in the sheet non-passage areas.

The upper end 60*s* and the lower end 60*t* of the annular portion 60B overlap when viewed in the axial direction. The ring parts of the shielding member 60 are formed by the straight portions 60*a* adjacent in the circumferential direction and the annular portions 60A, 60B connecting these straight portions 60*a*. On the other hand, since the insulating film 60*u* is interposed between the upper end 60*s* and lower end 60*t*, the upper and lower ends 60*s*, 60*t* can be reliably insulated from each other.

If the shielding member 60 composed of the annular portions 60B, 60A and the straight portions 60*a* is formed in the form of one plate, it is sufficient to curve the shielding member 60 along the outer surface of the center core 58. Thus, production is easier, for example, as compared with the case where separate ring parts are respectively connected.

By rotating the center core 58 in conformity with the sheet size by means of the controller 83 to move the shielding members 60, the shielding members 60 can be switched between the shielding positions and the retracted positions. In this way, excessive temperature increases of the heating belt 48 and the like can be prevented when it is not necessary to heat outside the minimum sheet passage area, i.e. to heat the sheet non-passage areas.

If the shielding member 60 is made of copper, a better magnetic shielding effect can be exhibited since copper has low electrical resistance and low magnetic permeability.

If the shielding member 60 is made of a nonmagnetic metal whose thickness lies in a range of 0.5 mm to 3 mm, a good conductive property can be ensured and a sufficient magnetic shielding effect can be obtained by sufficiently reducing the specific resistance of the shielding member 60 and, in addition, weight saving of the shielding member 60 can be realized. This is because the specific resistance (electrical resistance) of the member needs to be maximally reduced since the shielding member 60 efficiently shields magnetism by suppressing self-generation of Joule heat.

Further, the IH coil unit 50 adopts the external IH method, the coil 52 is arranged along the outer surface of the heating belt 48 and the arch cores 54 and the side cores 56 are arranged at the opposite sides of the center core 58. The center core 58 is arranged at such a position that the magnetic paths pass near the winding center line of the coil 52 via the cores 54, 56 at the opposite sides. In this case, since the center core 58 is located in the middle between the magnetic paths, one center core 58 can efficiently switch the shielding and passage of the magnetism.

If being arranged inside the heating belt 48, the shielding members 60 can be moved between the shielding positions and the refracted positions inside the heating belt 48. Thus, a good shielding effect can be obtained when magnetism is shielded and a good warm-up environment can be obtained when magnetism is not shielded.

Since the aforementioned magnetic shielding effect in the sheet non-passage areas is drastically improved, a good toner image is formed, with the result that the reliability of the image forming apparatus 1 is improved.

The present invention is not limited to the above embodiment and can be modified in various manners. For example, the shape of the center core 58 is not limited to the hollow cylindrical shape, and may be a solid cylindrical shape or a polygonal column shape.

Besides, the specific shapes of the respective parts such as the arch cores 54 and the side cores 56 are not limited to the shown ones and can be appropriately modified. In any of these cases, an effect of complete shielding magnetism in an area where magnetic shielding is necessary is exhibited similar to the above.

This application is based on Japanese Patent Application Serial No. 2009-106717, filed in Japan Patent Office on Apr. 24, 2009, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A fixing device, comprising:

a heating member;

a pressing member, the heating member and the pressing member fixing a toner image to a sheet by heat from the heating member while conveying the sheet having the toner image transferred thereto in a sandwiched state;

a coil generating a magnetic field to induction heat the heating member;

a fixed core made of a magnetic material and arranged around the coil to form a magnetic path between the fixed core and the heating member;

a movable core made of a magnetic material and so provided between the fixed core and the heating member with respect to a direction in which the coil generates the magnetic field as to form the magnetic path together with the fixed core, the movable core having an axis intersecting with the generation direction of the magnetic field and being rotatable about the axis;

a shielding member made of a nonmagnetic metal, provided on the movable core, and having a ring part capable of shielding magnetism in the magnetic field;

a position switching unit rotating the movable core about the axis to move the shielding member between a shielding position where the ring part shields magnetism and a retracted position where the ring part does not shield magnetism, the shielding position being a position where the magnetic field penetrates the ring part in one direction and the retracted position being a position where the magnetic field penetrates the ring part in two directions;

wherein:

a first area requiring the magnetic shielding and a second area not requiring the magnetic shielding are selectively set in the heating member, the shielding member includes a first annular portion provided at a position corresponding to a boundary part between the first and second areas, and the first annular portion has a shape closed in a circumferential direction and has an insulated part disposed at a circumferential position to cut electrical connection of the shielding member in the circumferential direction.

2. A fixing device according to claim 1, wherein:

the shielding member further includes a second annular portion located at a side of the first area opposite to the first annular portion, and straight portions connecting the first and second annular portions and spaced apart from each other in a circumferential direction of the first and second annular portions, the ring part is formed by the straight portions adjacent in the circumferential direction and the first and second annular portions connected by the straight portions, and the first annular portion has one end and the other end overlapping in the circumferential direction, and an electrically insulating member is interposed between the one end and the other end.

3. A fixing device according to claim 2, wherein the electrically insulating member is an insulating film so interposed between the one end and the other end as to cover the lower surface of the one end and the upper surface of the other end.

4. A fixing device according to claim 1, wherein:

the shielding member further includes a second annular portion located at a side of the first area opposite to the first annular portion, and straight portions connecting the first and second annular portions and spaced apart from each other in a circumferential direction of the first and second annular portions, the ring part is formed by the straight portions adjacent in the circumferential direction and the first and second annular portions connected by the straight portions, and the first annular portion has one end and the other end overlapping in the circumferential direction, and a specific clearance is formed between the one end and the other end.

5. A fixing device according to claim 2, wherein the shielding member is formed of one plate member formed with the first and second annular portions and the straight portions.

6. A fixing device according to claim 1, wherein:

the heating member includes a maximum sheet passage area corresponding to sheets of a maximum size and a minimum sheet passage area corresponding to sheets of a minimum size and capable of being induction heated by the coil over the maximum sheet passage area, and the movable core extends in the axial direction to form the magnetic path in the entire area of the heating member in a width direction of the heating member, and the shielding member is arranged outside the minimum sheet passage area when viewed in the axial direction of the movable core.

7. A fixing device according to claim 1, wherein the shielding member is made of copper.

8. A fixing device according to claim 1, wherein the thickness of the shielding member lies in a range of 0.5 mm to 3 mm.

9. A fixing device according to claim 1, wherein:

the coil is arranged along an outer surface of the heating member, the fixed core is a pair of cores arranged at the opposite sides of the movable core, and the movable core has an outer surface provided with the shielding member and is arranged at such a position that the magnetic path passes near a winding center line of the coil via the movable core.

10. A fixing device according to claim 1, wherein:

the coil is arranged along an outer surface of the heating member, and the shielding member is arranged inside the heating member.

11. An image forming apparatus, comprising:

an image forming section for forming a toner image on a sheet; and a fixing device for fixing the toner image on the sheet to the sheet; wherein the fixing device includes:

a heating member;

a pressing member, the heating member and the pressing member fixing a toner image to a sheet by heat from the heating member while conveying the sheet having me toner image transferred thereto in a sandwiched state;

a coil generating a magnetic field to induction heat the heating member;

a fixed core made of a magnetic material and arranged around the coil to form a magnetic path between the fixed core and the heating member;

a movable core made of a magnetic material and so provided between the fixed core and the heating member with respect to a direction in which the coil generates the magnetic field as to form the magnetic path together with the fixed core, the movable core having an axis intersecting with the generation direction of the magnetic field and being rotatable about the axis;

a shielding member made of a nonmagnetic metal, provided on the movable core, and having a ring part capable of shielding magnetism in the magnetic field;

a position switching unit rotating the movable core about the axis to move the shielding member between a shielding position where the ring part shields magnetism and a retracted position where the ring part does not shield magnetism, the shielding position being a position where the magnetic field penetrates the ring part in one direction and the retracted position being a position where the magnetic field penetrates the ring part in two directions;

wherein:

a first area requiring the magnetic shielding and a second area not requiring the magnetic shielding are selectively set in the heating member, the shielding member includes a first annular portion provided at a position corresponding to a boundary part between the first and second areas, and the first annular portion has a shape closed in a circumferential direction and has an insulated part disposed at a circumferential position to cut electrical connection of the shielding member in the circumferential direction.

12. An image forming apparatus according to claim 11, wherein:

the shielding member further includes a second annular portion located at a side of the first area opposite to the first annular portion, and straight portions connecting the first and second annular portions and spaced apart from each other in a circumferential direction of the first and second annular portions, the ring part is formed by the straight portions adjacent in the circumferential direction and the first and second annular portions connected by the straight portions, and the first annular portion includes one end and the other end overlapping in the circumferential direction, and an electrically insulating member is interposed between the one end and the other end.

13. An image forming apparatus according to claim 12, wherein the electrically insulating member is an insulating film so interposed between the one end and the other end as to cover the lower surface of the one end and the upper surface of the other end.

14. An image forming apparatus according to claim 11, wherein:

the shielding member further includes a second annular portion located at a side of the first area opposite to the first annular portion, and straight portions connecting the first and second annular portions and spaced apart from each other in a circumferential direction of the first and second annular portions, the ring part is formed by the straight portions adjacent in the circumferential direction and the first and second annular portions connected by the straight portions, and the first annular portion includes one end and the other end overlapping in the circumferential direction, and a specific clearance is formed between the one end and the other end.

15. An image forming apparatus according to claim 12, wherein the shielding member is formed of one plate member formed with the first and second annular portions and the straight portions.

16. An image forming apparatus according to claim 11, wherein:

the heating member includes a maximum sheet passage area corresponding to sheets of a maximum size and a minimum sheet passage area corresponding to sheets of a minimum size and capable of being induction heated by the coil over the maximum sheet passage area, and the movable core extends in the axial direction to form the magnetic path in the entire area of the heating member in a width direction of the heating member, and the shielding member is arranged outside the minimum sheet passage area when viewed in the axial direction of the movable core.

17. An image forming apparatus according to claim 11, wherein the shielding member is made of copper.

18. An image forming apparatus according to claim 11, wherein the thickness of the shielding member lies in a range of 0.5 mm to 3 mm.

19. An image forming apparatus according to claim 11, wherein:

the coil is arranged along an outer surface of the heating member, the fixed core is a pair of cores arranged at the opposite sides of the movable core, and the movable core has an outer surface provided with the shielding member and is arranged at such a position that the magnetic path passes near a winding center line of the coil via the movable core.

20. An image forming apparatus according to claim 11, wherein:

the coil is arranged along an outer surface of the heating member, and the shielding member is arranged inside the heating member.

* * * * *